US008228271B2

(12) United States Patent
Hirai et al.

(10) Patent No.: US 8,228,271 B2
(45) Date of Patent: Jul. 24, 2012

(54) ACTIVE-MATRIX DISPLAY AND DRIVE METHOD THEREOF

(75) Inventors: Tadahiko Hirai, Tokyo (JP); Jun Sumioka, Yokohama (JP); Kaoru Okamoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 415 days.

(21) Appl. No.: 12/515,680

(22) PCT Filed: May 21, 2008

(86) PCT No.: PCT/JP2008/059761

§ 371 (c)(1),
(2), (4) Date: May 20, 2009

(87) PCT Pub. No.: WO2008/149736

PCT Pub. Date: Dec. 11, 2008

(65) Prior Publication Data

US 2010/0073265 A1 Mar. 25, 2010

(30) Foreign Application Priority Data

May 30, 2007 (JP) ..... 2007-143501
Oct. 3, 2007 (JP) ..... 2007-259806
May 1, 2008 (JP) ..... 2008-119728

(51) Int. Cl.
*G09G 3/36* (2006.01)

(52) U.S. Cl. ..... 345/82

(58) Field of Classification Search ..... 345/98, 345/204, 55–83

See application file for complete search history.

(56) References Cited

U.S. PATENT DOCUMENTS 6,229,506 B1 5/2001 Dawson et al. ..... 345/82
6,373,454 B1 4/2002 Knapp et al. ..... 345/76
7,642,997 B2 * 1/2010 Hamer et al. ..... 345/76

(Continued)

FOREIGN PATENT DOCUMENTS

CA 2 472 689 A1 12/2005

(Continued)

OTHER PUBLICATIONS

International Search Report and Written Opinion in PCT/JP2008/059761.

(Continued)

*Primary Examiner* — Ke Xiao
(74) *Attorney, Agent, or Firm* — Fitzpatrick, Cella, Harper & Scinto

(57) ABSTRACT

An active-matrix display includes a data line, at least one select line, a control unit supplying a voltage signal and a current signal to the data line, and a pixel circuit receiving the voltage signal and the current signal from the data line to drive a light emitting element, the control unit including a voltage or first current source supplying a voltage or current pulse to the data line in order to make the voltage holding unit hold the voltage signal for making the light emitting element emit light having predetermined brightness in a first selection period in which the first switch is closed, a second current source supplying the current signal for making the light emitting element emit light having the predetermined brightness to the data line in a second selection period in which the first switch and the second switch are closed, a detection circuit detecting potential held in the voltage holding unit in the second selection period, and a correction unit correcting the voltage signal based on a relationship between the current signal and the detected potential.

12 Claims, 14 Drawing Sheets

U.S. PATENT DOCUMENTS

| | | | | |
|---|---|---|---|---|
| 7,696,965 | B2 * | 4/2010 | Cok | 345/82 |
| 2004/0233142 | A1 * | 11/2004 | Matsumoto et al. | 345/76 |
| 2005/0285822 | A1 * | 12/2005 | Reddy et al. | 345/76 |
| 2008/0048951 | A1 * | 2/2008 | Naugler et al. | 345/82 |
| 2008/0180365 | A1 * | 7/2008 | Ozaki | 345/76 |

FOREIGN PATENT DOCUMENTS

| | | | |
|---|---|---|---|
| JP | 2002-278513 | | 9/2002 |
| JP | 2006-308616 | | 11/2006 |
| JP | 2007-108774 | | 4/2007 |
| WO | WO 2005/029455 | A1 | 3/2005 |
| WO | 2007/037269 | | 4/2007 |
| WO | WO 2007/037263 | A1 | 4/2007 |
| WO | WO 2007037269 | A1 * | 4/2007 |

OTHER PUBLICATIONS

International Preliminary Report on Patentability and the Written Opinion of the International Searching Authority of International Application No. PCT/JP2008/059761 dated Dec. 10, 2009.

* cited by examiner

DATA TABLE
I
Vdata
V

PRE-CHARGE
CURRENT OBSERVATION
INSUFFICIENCY OF VOLTAGE
EXCESS OF VOLTAGE
VDL
Vdata
TIME VDL MEASUREMENT
n-th FRAME
SCAN DATA TABLE
SHIFT
I
Vdata'
V PRE-CHARGE
CURRENT OBSERVATION
REASONABLE VOLTAGE
VDL
Vdata'
TIME VDL MEASUREMENT
n+1-th FRAME

ACTIVE-MATRIX DISPLAY AND DRIVE METHOD THEREOF

TECHNICAL FIELD

The present invention relates to an active-matrix display and a drive method thereof. The present invention particularly relates to an active-matrix display including data lines, select lines each intersecting with the data lines, control units supplying signals to the data lines, and pixel circuits receiving the signals from the data lines to drive light emitting elements, and to a drive method of the active-matrix display.

BACKGROUND ART

In recent years, the development of electronic devices using organic semiconductor materials has widely been performed, and the development of organic electro-luminescence (EL) light emitting elements, organic thin film transistors (TFTs), organic solar cells, and the like have been reported. Among them, organic EL displays are expected as a promising technique closest to the practical realization thereof.

The configurations of organic EL display panels are classified into passive-matrix types and active-matrix types. The passive-matrix types are premised on impulse operation, and the current value to be flown at the time of lighting becomes large. Consequently there is a serious trade-off between the brightness of the passive-matrix type organic EL display and the span of the life thereof, and the passive-matrix type one is regarded as the one from which it is difficult to obtain a high brightness display panel. On the other hand, the active-matrix type organic EL display is not always driven by the impulse operation, and can be operated in nearly always lighted state. The active-matrix type one can consequently decrease the current value to be flown at the time of lighting, and is regarded as the one effective for the elongation of the span of the life of the organic EL element. However, the active-matrix type one has a problem of the conquest of the variations of TFTs and organic EL elements, and characteristic drifts.

Accordingly, a voltage programming method, a current programming method, and the like have been proposed, and the trials of correcting the variations of the TFTs and the characteristic drifts (chiefly threshold drifts) have been performed.

A first patent document (U.S. Pat. No. 6,229,506) discloses pixel circuits that compensate the variations of the thresholds of TFTs by a current programming method.

A second patent document (U.S. Pat. No. 6,373,454) discloses pixel circuits that perform more precise correction (the correction of the mobility changes and the like of TFTs) by a different current programming method from that of the first patent document.

A third patent document (WO-A1-2005029455) discloses an invention of correcting the characteristic drifts of TFTs and organic EL elements by flowing currents through organic EL elements by using current mirror circuits even if the saturation characteristics of TFTs are not sufficient (i.e., the TFTs cannot function as constant current sources).

A fourth patent document (Canadian Patent No. 2,472,689) discloses an invention for correcting current signals by using a current programming method and feedback circuits. FIG. 13 illustrates a comparative example of the feedback drive method disclosed in the fourth patent document. The pixel circuit of a pixel 30 includes a current mirror circuit including transistors T3 and T4, and a programming current is fed back to a circuit 32 through the reference transistor T3. At that time, the programming current is guided to the inverting terminal of an amplifier 33 in the circuit 32 through a feedback line 36. The pixel 30 further includes a select line 34, a data line 35, a holding capacitor Cs, and a light emitting element 31.

Because a signal to be fed back is the programming current itself in the circuit 32, a very small current must be fed back when low brightness is programmed. Because the addition of the feedback circuit is originally premised, the parasitic capacitance of the circuit is large, and the charging by very small current takes a long time, which is unsuitable for high speed driving.

The problem of the current programming method is that the charging of the load capacitance of a data line including the parasitic capacitance takes a long time because the current signal of low brightness is a small current, and that it is difficult for the current signal flowing through the pixel circuit in the low brightness especially to reach a steady state. Then, it is consequently hard to correctly program a current signal in the pixel circuit.

On the other hand, because a voltage signal is supplied onto a data line in the voltage programming method, the aforesaid problem of the current programming method does not exist, but it is difficult for the voltage programming method to deal with the variations of the threshold voltages and the mobility of transistors.

As described above, although the current programming method is excellent in the correction of device characteristics, the current programming method has a problem of the difficulty of high speed driving.

DISCLOSURE OF THE INVENTION

The present invention provides an active-matrix display having almost the equal correction ability to that of the current programming and achieving a high speed driving, and a drive method of the active-matrix display.

An active-matrix display of the present invention includes the following configuration comprising:

a data line;

one or a plurality of select lines intersecting with the data line;

a control unit that supplies a voltage signal and a current signal to the data line; and a pixel circuit that receives the voltage signal and the current signal from the data line to drive a light emitting element, wherein the pixel circuit includes:

a transistor that controls a current to be supplied to the light emitting element;

a voltage holding unit connected to a gate of the transistor;

a first switch controlled by a signal supplied through the select lines to connect the gate of the transistor to the data line; and a second switch controlled by the signal supplied through the select lines to connect the drain of the transistor to the data line, wherein the control unit includes:

a voltage or first current source that supplies a voltage or current pulse to the data line in order to make the voltage holding unit hold the voltage signal for making the light emitting element emit a light having predetermined brightness in a first selection period in which the first switch is closed by the signal supplied through the select lines;

a second current source that supplies the current signal for making the light emitting element emit the light having the predetermined brightness to the data line in order to make the voltage holding unit hold the current signal in a second selection period in which the first switch and the second switch are closed by the signal supplied through the select lines;

a detection circuit that detects potential held in the voltage holding unit in the second selection period; and a correction unit that corrects the voltage signal on the basis of a relationship between the current signal and the detected potential.

An active-matrix display drive method of the present invention is a drive method of an active-matrix display including a data line, one or a plurality of select lines intersecting with the data line, a control unit that supplies a voltage signal and a current signal to the data line, and a pixel circuit that receives the voltage signal and the current signal from the data line to drive a light emitting element, wherein the pixel circuit includes a transistor that controls a current amount of a current to be supplied to the light emitting element, and a voltage holding unit connected to a gate of the transistor, the drive method comprising the steps of:

providing a light emitting period in which the current is flown through the light emitting element to make the light emitting element emit a light having predetermined brightness and a selection period in which the current to be flown through the light emitting element is set before the light emitting period;

supplying a voltage or current pulse to the data line to make the voltage holding unit hold the voltage signal;

after that, supplying the current signal to the data line to flow the current signal through the transistor;

detecting potential held in the voltage holding unit in the current signal supplying step; and correcting the voltage signal on the basis of a relationship between the current signal and the detected potential.

According to the present invention, a high speed active-matrix display capable of performing a highly precise correction and a drive method of the active-matrix display can be provided.

Further features and aspects of the present invention will become apparent from the following detailed description of exemplary embodiments with reference to the attached drawings.

BEST MODE CARRYING OUT THE INVENTION

Figure 1:
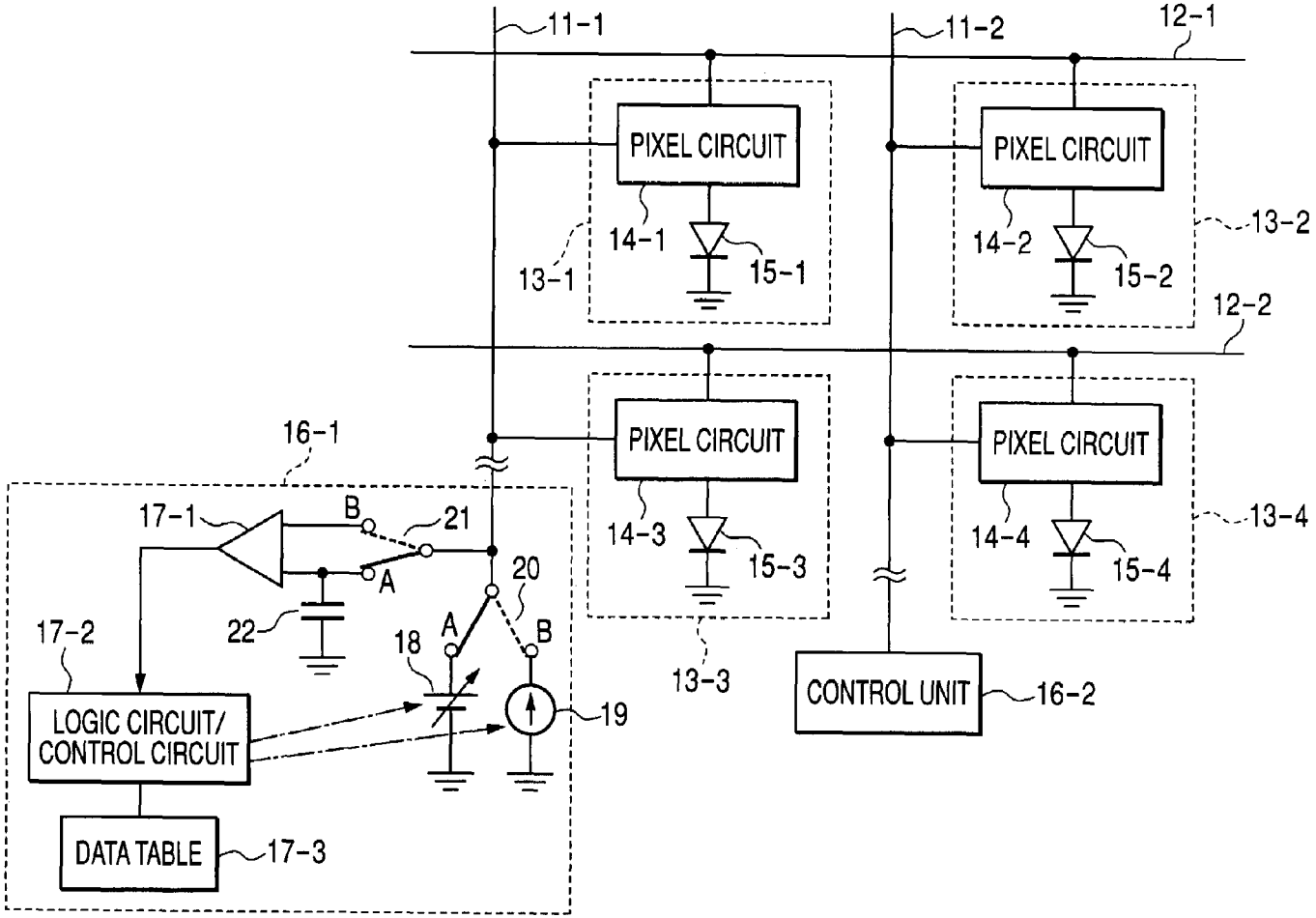
FIG. 1 is a diagram showing a rough configuration of an active-matrix display according to an exemplary embodiment of the present invention.

A selection period in which programming is performed is attained by dividing the selection period into the two stages of a first period (which is a first selection period) and a second period (which is a second selection period) in the present exemplary embodiment. In the first period, voltage programming is performed by supplying a voltage signal from a data line to a pixel. Current programming is performed by supplying a current signal corresponding to the voltage signal from the data line to the pixel in the second period immediately after the first period. In case of low brightness, it is difficult to charge the load capacitance of the data line in the selection period only by the current signal. However, because the present exemplary embodiment supplies a voltage or current pulse from the data line to the pixel before the supplement of the current signal thereto to pre-charge the voltage signal into the holding capacity of the pixel, the load capacitance reaches the steady state thereof in a short time even if the current signal is minute, and the current signal can be correctly programmed.

Although the voltage signal to be pre-charged is desirable to be a voltage close to the voltage held in the pixel by the current signal immediately after the voltage signal, if the threshold voltage or the mobility of the transistor of the pixel shows variation or drift, the held voltage shifts from a correct hold voltage. By the present invention, a detection circuit detects the potential held in a voltage holding unit in a current programming period. Then, the present invention corrects the voltage signal to be supplied to the data line in a voltage programming period on the basis of the relationship between the current signal in the current programming period and the detected potential. To put it concretely, the present invention is arranged to update the voltage signal according to the detected potential and the current signal, and to keep the voltage signal to have the same value as or a close value to the voltage held in the pixel by the current signal.

The voltage held in the pixel by the voltage programming is stored in a holding capacitor (holding capacity) in the pixel. On the other hand, the current signal supplied from the data line in the current programming period becomes the drain current of a transistor, the gate and the drain of which are shorted, and the gate-source voltage at that time is stored in the same holding capacity. Consequently, if the voltage signal in the voltage programming period agrees with the voltage held in the pixel in the current programming period, then the potential of the data line does not vary in both of the periods.

On the other hand, if the voltage signal in the voltage programming period differs from the current signal at the time of the current programming, then the potential at the time of the current programming changes from the potential at the time of the voltage programming.

Concrete potential changes will be described in the following exemplary embodiments. If the voltage signal is corrected on the basis of the potential stored in the holding capacitor at the time of the current programming, then the more precise voltage signal can be obtained. The correction method can suitably be selected according to the characteristics of the changes of the potential.

If the variation of the threshold voltage of the transistor and the temporal change thereof are the dominant primary factors of the potential difference, then the difference between the potential in the voltage programming period and the potential in the current programming period is detected, and a predetermined amount of the voltage signal is increased or decreased according to the detect potential difference. Thereby, a precise voltage signal can be obtained. To put it concretely, the variation direction and the variation voltage amount are detected, and the voltage signal is corrected so as to be larger or smaller in the detected direction by a suitable voltage amount. Then, the precise voltage signal can be obtained.

If a variation of the inclination of the current-voltage characteristic of the transistor and the temporal change thereof are the dominant primary factors of the potential difference, it is difficult for the aforesaid method to obtain the precise voltage signal. In this case, the difference between the potential in the voltage programming period and the potential in the current programming period is detected, and the voltage signal is multiplied by a predetermined ratio according to the detected potential difference. Thereby, a precise voltage signal can be obtained.

Moreover, if both of the threshold voltage and the inclination of the current-voltage characteristic change, then it is difficult to perform the correction only by detecting the potential at one point, and consequently it is required to detect a plurality of potential values. In this case, it is necessary to detect the relationships between the current signals in order to make the light emitting element emit a light having predetermined brightness and the potential of the voltage holding unit at that time to a plurality of different brightness values from one another.

Now, also the light emitting element has variations and temporal changes caused in different aspects from those of the transistor (TFT). In particular, in an organic EL element, temporal changes of the current brightness characteristic thereof are remarkable. As mentioned above, if not only the changes of the characteristic of the transistor but also the changes of the current brightness characteristic of the light emitting element exist, the correlation between the characteristic changes of the transistor and the changes of the current brightness characteristic is obtained in advance, and then the correction based on the characteristic changes of the light emitting element can be performed.

The variations of the transistor and the aged deterioration thereof can be compensated by this method.

The transistor, the gate of which is shorted to the drain thereof in the current programming period, can be considered as a current verifying unit that performs the so-called verification of whether the voltage signal held in the pixel by the voltage programming generates a correct drain current or not.

Another feature of the present exemplary embodiment is that the transistor constituting the current verifying unit is connected to the light emitting element. That is, the source of the transistor, the gate of which is shorted to the drain thereof, is connected to the light emitting element. The current signal flows through the drain-source of the transistor and the light emitting element in series.

If the voltage between the terminals of the light emitting element changes to be larger, then the source potential of the transistor becomes high. Consequently, if the same current signal as the one before a change is flown, the gate potential, that is, the data line potential changes to be higher. The voltage signal at the time of the voltage programming is consequently corrected to be higher. As the result, the corrected high voltage signal is output to the data line at the time of the next voltage programming, and a precise voltage or a close voltage to the precise voltage is held in the holding capacity.

If the voltage between the terminals of the light emitting element changes to be smaller, the invert correction is performed.

By flowing the current signal in the current programming period through both of the transistor and the light emitting element in series in this manner, even if the voltage between the terminals of the light emitting element changes, the voltage signal is corrected by following the change. Consequently, the almost same hold voltages can be given to the holding capacity both in each of the voltage programming and the current programming.

Even if both of the transistor (TFT) and the light emitting element change their characteristics, the correction of the voltage signal is similarly performed, and the characteristic change is compensated.

The present exemplary embodiment can obtain two or more pairs of voltage and current values (the values of a paired voltage signal and a current signal) obtained in the first period (first selection period) and the second period (second selection period) with respect to the same pixel. By this feature, a plurality of parameters of the current-voltage characteristic of the pixel circuit can be corrected.

Because the correction value of the voltage signal is determined on the basis of the data line potential change immediately after the voltage signal is output to the data line, the correction value cannot be used for the voltage programming. But, the corrected voltage signal is stored, and thus is used at the time of outputting the voltage signal in the next voltage programming period.

Moreover, in this method, only the voltage signal actually output onto the data line is corrected. However, assuming that the changes of the voltage signals are caused by the shifts of the threshold voltages of the transistors, or that the changes are those of the mobility of the transistors, the correction to one voltage signal can be expanded to the correction of the whole voltage signal as it will be described in the following exemplary embodiments in detail.

Moreover, if it is assumed that the whole variation of the drive transistor is only the shifts of the threshold voltage, a resistance change amount of the light emitting element can be calculated on the basis of the current-voltage characteristics of the light emitting element and the transistor (drive transistor) that supplies a current to the light emitting element. It is known that the resistance changes (the increases of the resistance) of the light emitting element relate to the current brightness characteristic of the light emitting element. The resistance change amount of the light emitting element enables the correction of the current brightness characteristic of the light emitting element to supply suitable current and voltage values to the necessary brightness.

First Embodiment

A first embodiment of the active-matrix display of the present invention will be described in the following. In the present exemplary embodiment, a mode of correcting a voltage signal on the basis of the difference between the hold potential at the time of voltage programming and the hold potential at the time of current programming will be described.

FIG. 1 shows the outline of the embodiment of the present invention, and illustrates four pixels of the exemplary embodiment.

As shown in FIG. 1, the active-matrix display includes a plurality of data lines 11-1 and 11-2 intersecting with a plurality of select lines 12-1 and 12-2. Four pixels 13-1, 13-2, 13-3, and 13-4 are arranged correspondingly to the intersection points of the plurality of data lines 11-1 and 11-2 and the plurality of select lines 12-1 and 12-2. The pixel 13-1 includes an organic EL element (light emitting element) 15-1 and a pixel circuit 14-1, and the pixel 13-2 includes an organic EL element 15-2 and a pixel circuit 14-2. Moreover, the pixel 13-3 includes an organic EL element 15-3 and a pixel circuit 14-3, and the pixel 13-4 includes an organic EL element 15-4 and a pixel circuit 14-4. Incidentally, an inorganic EL element may be used as the light emitting element in place of the organic EL element.

Control units 16-1 and 16-2 are connected to the data lines 11-1 and 11-2, respectively. Each of the control units 16-1 and 16-2 includes a voltage source 18 generating a pre-charge voltage, a current source 19 (which is a second current source) for flowing a predetermined current, a comparator 17-1, a logic circuit/control circuit 17-2, a data table (storage unit) 17-3 connected to the logic circuit/control circuit 17-2, and switches 20 and 21. The comparator 17-1 and the logic circuit/control circuit 17-2 constitute a detection circuit. Incidentally, although the comparator 17-1 is used as a part of the detection circuit here, an AD converter can also be used as described below. The switch 20 performs the switching of connecting either of the voltage source 18 and the current source 19 to the data line 11-1. The switch 21 performs the switching of connecting either of the two inputs of the comparator 17-1 to the data line 11-1. A capacitor 22 is connected to the input terminal of the comparator 17-1 on one side.

When the switch 20 of the control unit 16-1 is switched to the A side thereof, the pre-charge voltage (voltage signal) set in the voltage source 18 is applied to the pixel circuit 14-1, which is activated by the select line 12-1. On the other hand, when the switch 20 of the control unit 16-1 is switched to the B side thereof, a predetermined current (current signal) is applied from the current source 19 to the pixel circuit 14-1. Similar operations are performed from the control unit 16-2 to the pixel circuit 14-2.

Figure 2:
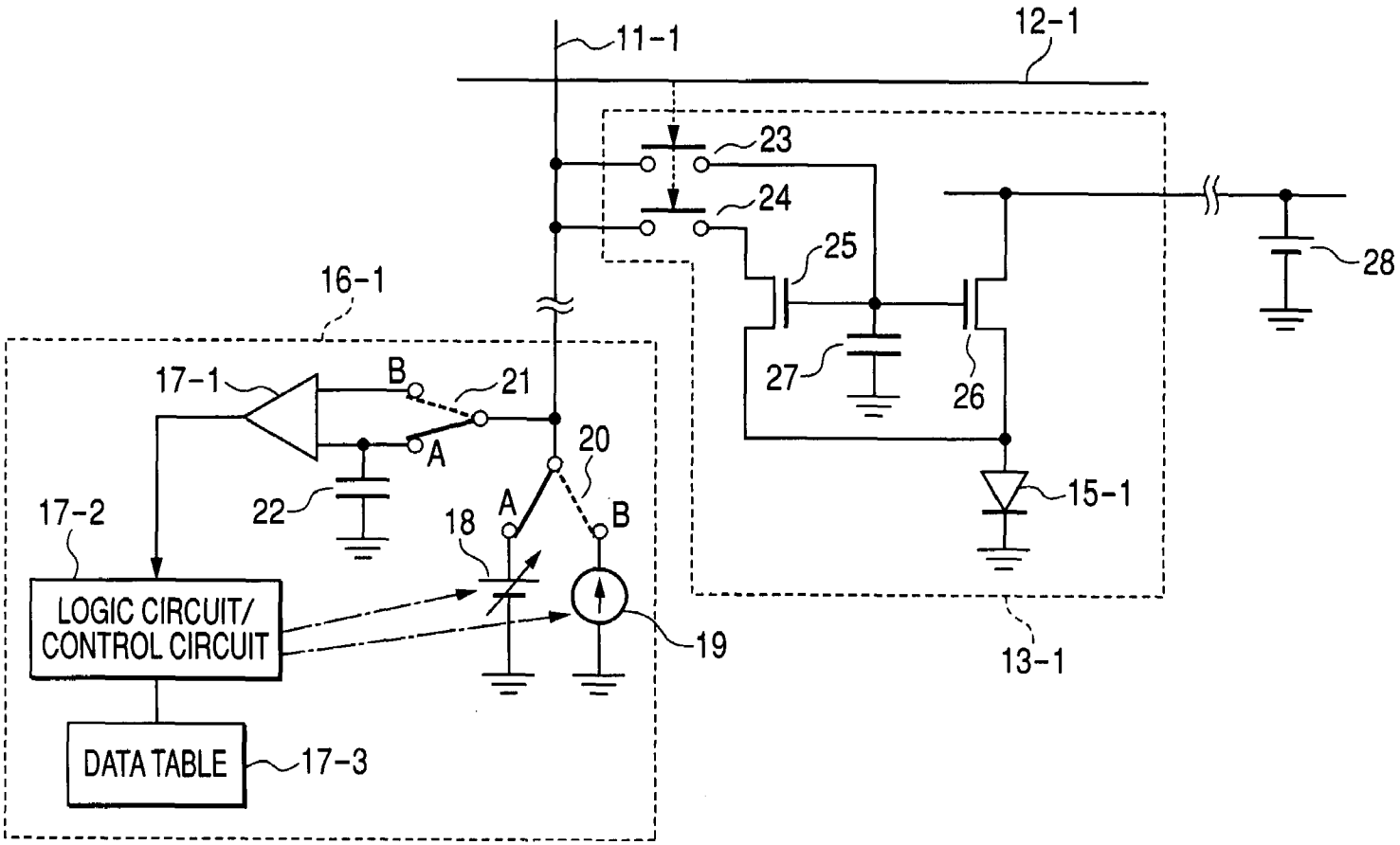
FIG. 2 is a diagram showing the configurations of a pixel and a control unit according to an exemplary embodiment of the present invention.

FIG. 2 shows an example of the configuration of a pixel circuit. FIG. 2 shows the configurations of the pixel 13-1 and the control unit 16-1.

By the select line 12-1, a switch 23, which is a first switch in the pixel circuit 14-1 in the pixel 13-1, and a switch 24, which is a second switch in the pixel circuit 14-1, are turned on. By switching over the switch 20, the pre-charge voltage (voltage signal) and the predetermined current (current signal) are sequentially applied from the control unit 16-1 to the pixel circuit 14-1. In this example, the pixel 13-1 includes a holding capacitor 27 as a voltage holding unit and a current mirror circuit as a current verifying unit. The current minor circuit includes transistors 25 and 26, the gates of which are mutually connected. The holding capacitor 27 is connected to the commonly connected gates. The pixel 13-1 further includes a voltage source 28 connected to the drain of the transistor 26.

In the control unit 16-1, either of the two input terminals of the comparator 17-1 is connected to the data line 11-1 through the switch 21, and the two input terminals of the comparator 17-1 are connected respectively to the A terminal side and the B terminal side of the switch 21. The capacitor 22 is connected to the A terminal side of the switch 21.

Figures 3A, 3B, 3C, 3D, 3E, 3F:
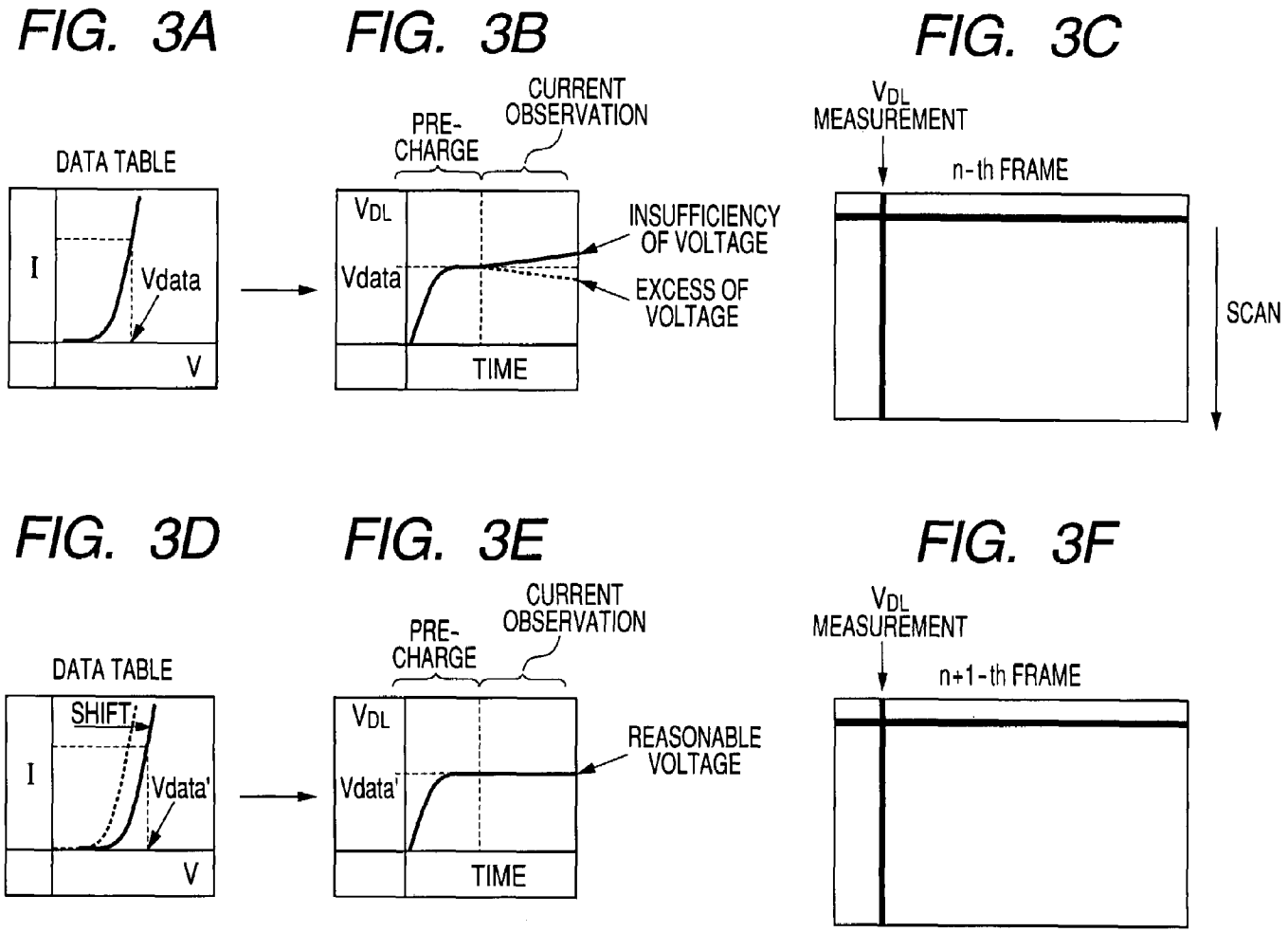
FIGS. 3A, 3B, 3C, 3D, 3E, and 3F are exemplary diagrams for describing the operation and the function of the control unit according to the exemplary embodiment of the present invention.

FIGS. 3A to 3F are explanatory diagrams for describing the operation and the function of the control unit 16-1. FIG. 3A illustrates the relationship between a voltage signal by which the pre-charge voltage is determined and the current signal corresponding to the voltage signal. The data table (storage unit) 17-3 initially stores the relationship.

FIG. 3B shows the variations of data line potential $V_{DL}$ when a pre-charge voltage $V_{data}$ is supplied from the control unit 16-1 to the data line 11-1 and then the current signal determined on the basis of the relationship of FIG. 3A is supplied to the data line 11-1.

If the data line potential $V_{DL}$ is assumed to be the value of 0 (the potential of the holding capacity 27), then the pre-charge voltage $V_{data}$ is applied to the data line 11-1. When the switch 23 in the pixel circuit 14-1 is closed (in the conductive state thereof), the holding capacity 27 is charged, and the data line potential $V_{DL}$ reaches the pre-charge voltage $V_{data}$. Because the switch 24 is also closed (in the conductive state thereof) at this time, a current flows through the transistor 25 and the light emitting element 15-1. After that, when the voltage signal is switched to the current signal, the current signal flows into the transistor 25 and the light emitting element 15-1 through the switch 24 in the pixel circuit 14-1. When the current consists with the current flowing through the transistor 25 and the light emitting element 15-1 in the pre-charge period, the data line potential $V_{DL}$ does not change. However, when any one of the threshold voltage of the transistor 25, the saturation current thereof, and the voltage between both the terminals of the light emitting element 15-1 has changed from the value at the time of the initial setting in the data table 17-3, the current at the time of the application of the current signal does not consist with the current in the pre-charge period, and the data line potential $V_{DL}$ varies from the pre-charge voltage $V_{data}$ to a voltage $V_{data*}$. When the varied pre-charge voltage $V_{data*}$ is smaller than the pre-charge voltage $V_{data}$, which gives the correct current, as shown with the solid line in FIG. 3B, the data line potential $V_{DL}$ rises. When the varied pre-charge voltage $V_{data*}$ is larger than the pre-charge voltage $V_{data}$, which gives the correct current, as shown in the broken line in FIG. 3B, the data line potential $V_{DL}$ falls.

FIG. 3C is the whole view of the display device. Select lines and data lines are provided in the row directions and the column directions, respectively. A control unit (not illustrated) is provided to each of the data lines.

A row select line shown with a bold line is selected, and the supplying of the pre-charge voltage and the current signal illustrated in FIG. 3B is performed at one data line at that time. The data line potential $V_{DL}$ is then measured. The measurement is also performed to the other pixels as the select lines are sequentially scanned.

FIG. 3D shows changes of the data in the data table (storage unit) when the data line potential change is a potential rise as shown with the solid line in FIG. 3B. In order to obtain the predetermined brightness in this case, the data in the data table is wholly shifted to the positive side by one step (0.5 V in this case) because the changes show the insufficiency of the pre-charge voltage $V_{data}$. Incidentally, the shift may be performed by the difference between the voltages $V_{data}$ and $V_{data*}$.

FIGS. 3E and 3F show the states of the potential change measurement of the same pixel at the time of the scanning of the next display ((n+1)$^{th}$ frame). A pre-charge voltage $V_{data'}$ according to a brightness signal is applied to a data line (a). Next, the current corresponding to the pre-charge voltage $V_{data'}$ is given to the pixel through the data line (a) in a current observation period with reference to the data table after changing. At this time, because the pre-charge voltage $V_{data'}$ is reasonable, the potential of the pixel does not change.

In this manner, the data table is updated, and the pre-charge voltage (voltage signal) corresponding to the predetermined brightness and the current corresponding to the pre-charge voltage are led to be applied.

Two methods can be considered as the method of observing the pre-charge voltages $V_{data}$ and $V_{data*}$. One of them is the method of using a comparator for sensing a data line voltage to perform the method shown in FIGS. 3A to 3F until the sign of the output is inverted (until the pixel potential is over-modified). The other one of then is the method of using an A/D converter for the sensing of the data line voltage to directly observe the difference between the data line voltages in the pre-charge period and the current observation period.

The determination of a potential change in the present invention means to compare the potential at the time of pre-charge and the potential at the time of applying the predetermined current to determine which potential is higher. For this purpose, a comparator for potential comparison or an A/D converter for the conversion of the potential difference (analog value) into digital data can be used.

In the case of using the comparator, the pre-charge voltage is compared with the voltage at the time of the current application to determine the magnitude thereof. In this case, the parameters of a data table are varied by one step on the basis of the information of the magnitude relationship. The operation of varying the parameters by one step is described here. For example, a threshold voltage change amount ±1 V is divided into ±256 steps in advance, and the threshold voltage of the data table is shifted by one step in accordance with the magnitude determination by the comparator. By repeating this operation the threshold voltage value becomes closer to the suitable threshold voltage value.

Moreover, in the case of using the A/D converter, the pre-charge voltage and the voltage at the time of current application are compared with each other, and the magnitude relationship and the potential difference (analog value) are measured. Because the A/D converter can convert the potential difference into a digital signal, for example, the potential difference can be detected as a change amount of the threshold voltage. In this case, the suitable modification of the data table can be performed by one correction operation using the pre-charge and the predetermined current application.

The data table 17-3 of the control unit 16-1 stores the electric characteristic data (such as voltage value-current value characteristics, voltage value-brightness characteristics, and predetermined parameters representing characteristics) of the pixel circuit 14-1. By referring to and calculating the data table, a voltage corresponding to necessary brightness is selected, and the pre-charge voltage of the voltage source 18 is set. A table 1 shows an example of the data table.

TABLE 1

| Program Voltage [V] | OLED Current [μA] | Brightness [cd/m$^2$] |
|---|---|---|
| 0 | 0 | 0 |
| 0.5 | 0 | 0 |
| 1 | 0 | 0 |
| 1.5 | 0 | 0 |
| 2 | 0 | 0 |
| 2.5 | 0 | 0 |
| 3 | 0.00284 | 0.00742 |
| 3.5 | 0.016204 | 0.48046 |
| 4 | 0.065649 | 3.06766 |
| 4.5 | 0.149693 | 8.75066 |
| 5 | 0.383596 | 28.06466 |
| 5.5 | 0.634835 | 51.88466 |
| 6 | 1.216305 | 111.38466 |
| 6.5 | 1.787719 | 171.78466 |
| 7 | 3.051849 | 303.68466 |
| 7.5 | 4.232962 | 426.68466 |
| 8 | 6.709534 | 676.18466 |
| 8.5 | 8.951789 | 893.28466 |
| 9 | 13.43004 | 1301.98466 |
| 9.5 | 17.25168 | 1629.98466 |
| 10 | 24.7407 | 2228.98466 |

The switches 20 and 21 are switched over to their A terminal sides, and the pre-charge voltage $V_{data}$ set through the data line 11-1 is applied to the pixel circuit 14-1 selected through the select line 12-1. In the pixel circuit 14-1, the switches 23 and 24 are turned on, and the pre-charge voltage is held in the capacity 27. Moreover, in the control unit 16-1, the pre-charge voltage is held in the capacity 22.

Next, the switches 20 and 21 are switched over to their B terminal sides in the state in which the switches 23 and 24 in the pixel 14-1 are turned on, and the predetermined current is supplied from the current source 19 to the pixel 14-1 through the data line 11-1. The predetermined current is set by referring to and calculating the data table 17-3 so as to correspond to the necessary brightness.

The control unit 16-1 observes the potential changes of the data line 11-1 from immediately after the supplying of the current. The observation of the potential changes of the data line 11-1 is performed by comparing the pre-charge voltage held in the capacity 22 with the potential of the data line 11-1 with the comparator 17-1, and by changing the electric characteristic data in the data table 17-3 on the basis of the information of the magnitude relationship with the logic circuit/control circuit 17-2.

In the following, the procedure of the changes will be described.

If it is assumed that a signal for making the brightness of the light emitting element 15-1 be 28 cd/cm$^2$ is given, the logic circuit/control circuit 17-2 of the control unit 16-1 reads the voltage data of 5 V from the row of the data table 17-3 in which the brightness of 28.06466 cd/cm$^2$ is provided, and the voltage is set in the voltage source 18 to be output to the data line 11-1 as the pre-charge voltage.

Next, the logic circuit/control circuit 17-2 reads the corresponding current of 0.383596 μA from the data table 17-3, and sets the current source 19 to the value to output the current to the data line 11-1. At this time, if the data line potential rises from 5 V, this rise means that the pre-charge voltage is too small for the necessary brightness. Accordingly, the voltage of the data table 17-3 must be changed to the higher side. If a previously determined correction amount is 0.5 V, the voltage data of 5 V is changed to 5.5 V.

However, if only the data of 5 V output onto the data line 11-1 is changed and the other voltage data are left as they are, then the voltage data that has not been corrected may be output if another piece of voltage data is read at the next reading of the data table 17-3.

Accordingly, at the time of correcting the voltage data in the data table 17-3, not only the voltage data output onto the data line 11-1 as the pre-charge voltage but also the whole voltage data can be corrected all together.

One of the methods of changing the whole voltage data all together is to uniformly shift the voltages in the data table 17-3 on the basis of the consideration such that the cause of the shifts of the pre-charge voltage $V_{data}$ to be higher too much or to be lower too much is the variations of the threshold voltage of the transistor 25 of the pixel circuit 13-1. If the pre-charge voltage data $V_{data}$ of 5 V is determined to be changed to 5.5 V on the basis of the potential change of the data line 11-1, the other voltage data are also each changed to be larger by 0.5 V all together.

A table 2 shows the data table changed in this manner.

TABLE 2

| Program Voltage [V] | OLED Current [μA] | Brightness [cd/m$^2$] |
|---|---|---|
| 0 | 0 | 0 |
| 0.5 | 0 | 0 |
| 1 | 0 | 0 |
| 1.5 | 0 | 0 |
| 2 | 0 | 0 |
| 2.5 | 0 | 0 |
| 3 | 0 | 0 |
| 3.5 | 0.00284 | 0.00742 |
| 4 | 0.016204 | 0.48046 |
| 4.5 | 0.065649 | 3.06766 |
| 5 | 0.149693 | 8.75066 |
| 5.5 | 0.383596 | 28.06466 |
| 6 | 0.634835 | 51.88466 |
| 6.5 | 1.216305 | 111.38466 |
| 7 | 1.787719 | 171.78466 |
| 7.5 | 3.051849 | 303.68466 |
| 8 | 4.232962 | 426.68466 |
| 8.5 | 6.709534 | 676.18466 |
| 9 | 8.951789 | 893.28466 |
| 9.5 | 13.43004 | 1301.98466 |
| 10 | 17.25166 | 1629.98466 |

A voltage corresponding to the necessary brightness is selected from the data table 17-3 after the change, and the pre-charge voltage $V_{data'}$ is newly set. The new pre-charge voltage $V_{data'}$ will be applied (to increase the voltage signal) at the time of the pixel selection (access on and after the next) on and after the next frame.

If the pre-charge voltage $V_{data}$ is determined to be higher than the one corresponding to the necessary brightness as the result of the detection of the potential change, then the voltage signal is decreased. That is, a certain amount of the voltage signal is increased or decreased on the basis of the detected potential change.

Another method of changing the whole voltage data all together is to multiply the whole data by a certain ratio after subtracting the threshold voltage from the voltage data on the basis of the assumption that the cause of the data line variation is the change of the mobility of the transistor 25 in the pixel circuit 13-1.

It is also possible to assume that the cause of the data line potential change is the change of a specific parameter of the pixel circuit 14-1 other than the threshold voltage and the mobility, and to change the voltage data on the basis of such change of the parameter.

Incidentally, the data table may include only the relationship between the current and the voltage on the basis of assumption that the relation between the brightness and the current is invariable.

By such operations, the correction effects capable of high speed driving and being a match for the current programming method can be obtained.

The correction operation using such pre-charge and predetermined current application can be performed to all the pixels in a scan of one frame. Moreover, as the occasion demands, the correction operation can be performed only to the pixels for one to several scanning lines in one frame. For example, if the correction operation is performed only to the pixels for one scanning line in one frame, then the correction operation can be performed to all the pixels in the number of frames corresponding to the number of the scanning lines by shifting the scanning line to be corrected every frame. Moreover, the correction operation may be performed to the pixels for one to several scanning lines in one frame, and the correction data may be applied to the whole pixel. If the correction operation is performed to all the pixels in the scanning of one frame, then the correction operation may be performed only to the necessary frames in the frames after that. Furthermore, it is also possible to perform the correction operation to a part or the whole pixel at the time of starting the display.

Moreover, a different data table can be stored in a storage device with respect to each pixel, and the data table can be rewritten for every correction operation of the pixel (correction operation using pre-charge and predetermined current application). As the occasion demands, the same data table can be used for the whole pixel or some blocks of pixels, and only some parameters (threshold voltage shift amount in the example of FIGS. 3A to 3F) are stored in the storage device to each pixel. Thereby, the data table can be rewritten for every correction operation of the pixels.

Second Embodiment

Figure 4A:
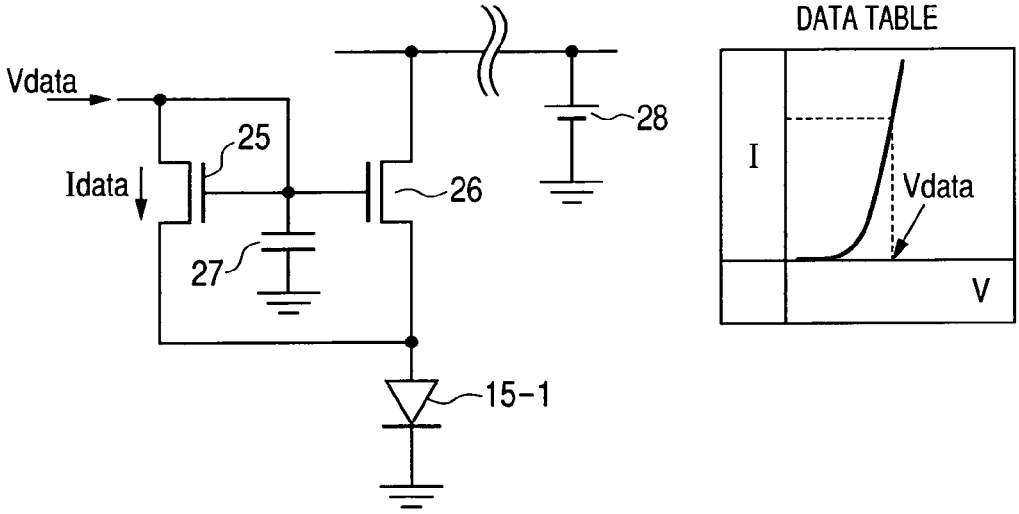
FIGS. 4A, 4B, and 4C are explanatory diagrams for describing the operation and the function of another exemplary embodiment of the present invention.
Figure 4B:
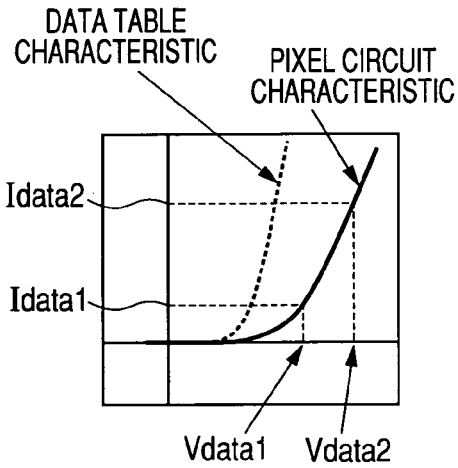
Figure 4C:
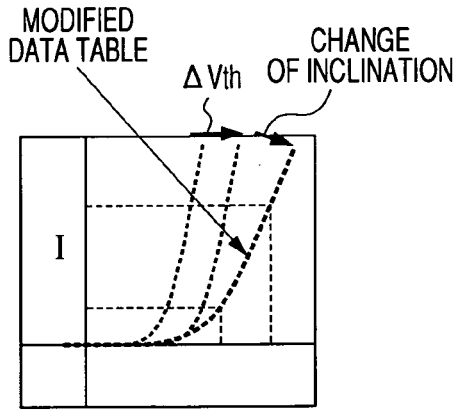

A second embodiment of the active-matrix display of the present invention will be described in the following. In the present embodiment, the case of changing two parameters in order to correctly correct the relationship between a voltage signal and a current signal, which are stored in a storage unit, will be described. FIGS. 4A to 4C show the case of changing two parameters.

As an example, a current and a voltage to be applied to the pixel circuit shown in FIGS. 4A to 4C to generate certain brightness are denoted by $I_{data}$ and $V_{data}$, respectively. The data table (storage unit) shown in FIG. 4A stores the relationship between the current and the voltage at this time. If the voltage $V_{data}$ necessary to pre-charge is specified, then the current value $I_{data}$ necessary to the current application in a current observation period can be determined.

As described above (FIGS. 3A to 3F), if only a threshold voltage shifts, the correction for at least one step is completed by applying the voltage $V_{data}$ in a pre-charge period and the current $I_{data}$ in the current observation period severally once.

However, if both the threshold value and an inclination shift as shown in FIG. 4B in the current-voltage characteristic of a pixel circuit, then the correction cannot be performed by the operation describe above (FIGS. 3A to 3F). In this case, as shown in FIG. 4B, the pre-charge is performed by a voltage $V_{data1}$, following which the operation of current application using a current value $I_{data1}$ corresponding to the voltage $V_{data1}$ stored in a data table as a current signal is performed. Then, the operation is also performed to a voltage signal of a voltage $V_{data2}$ different from the voltage $V_{data1}$ and a current $I_{data2}$ corresponding to the voltage $V_{data2}$. The potential $V_{data1*}$ and $V_{data2*}$ of a data line (holding capacity) are then severally detected at the time of current application. The two pairs of the values of the voltage $V_{data*}$ and the current $I_{data}$ (a pair of the voltage $V_{data1*}$ and the current $I_{data1}$, and a pair of the voltage $V_{data2*}$ and the current $I_{data2}$) are held in the memory (second storage unit) of the logic circuit/control circuit 17-2.

In the example of FIGS. 4A-4C, two parameters of a threshold shift amount (ΔVth) and an inclination change amount (ΔdI/dV) can be obtained by performing an operation based on the two pairs of the values of the voltage $V_{data*}$ and the current $I_{data}$.

As in this example, after obtaining the threshold shift amount and the inclination change amount, as shown in FIG. 4C, the threshold shift amount and the inclination change amount are applied to change the data table values of the data table 17-3, and then the correction is completed. An equation to define the relationship between the current and the voltage may be stored as a storage means in place of the data table. In that case, the correction is performed by changing the coefficients of the equation by performing operations based on the two pairs of the values of the voltage $V_{data*}$ and the current $I_{data}$.

If it is assumed that the equation can be expressed as the following formulae by the simplification for description, the correction is performed by changing the coefficients α and $V_1$: Formula 1

$$I=0 \text{ (in case of } V<V_1\text{), and}$$

$$I=\alpha(V-V_1)^2 \text{ (in case of } V\geqq V_1\text{).}$$

Incidentally, if the data stored in the storage unit is corrected by the operations of the logic circuit/control circuit 17-2 based on the two pairs of the values of the voltage $V_{data*}$ and the current $I_{data}$ in this manner, the comparison of the voltages $V_{data}$ and $V_{data*}$ may not be performed. The reason is that the correction is not the correction of shifting the values of the data table by the difference between the voltages $V_{data}$ and $V_{data*}$.

Third Embodiment

A third embodiment of the active-matrix display of the present invention will be described in the following. The present embodiment is an embodiment in case of correcting the relationship between a voltage signal and a current signal, which are stored in a storage unit, by additionally considering the characteristic change of a light emitting element.

Figure 14A:
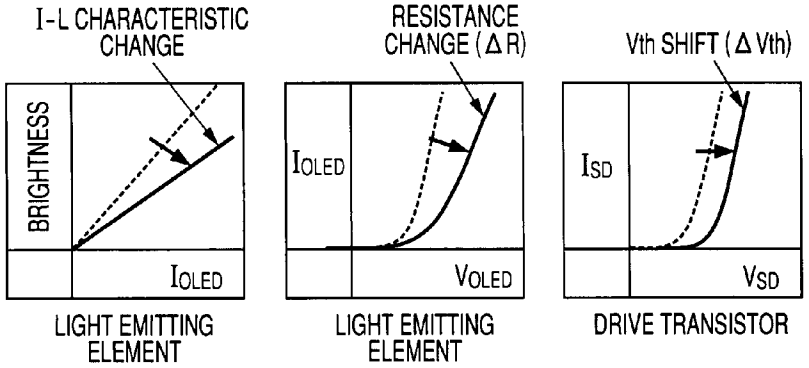
FIGS. 14A, 14B, and 14C are schematic diagrams showing the characteristic configurations of a pixel and a control unit of an active-matrix display of the present invention.
Figure 14B:
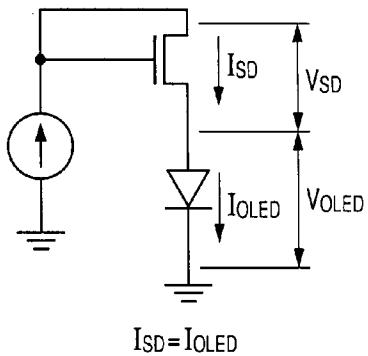

Even if a resistance change of a light emitting element shown in FIG. 14A and a change of the threshold voltage of a drive transistor shown in FIG. 14B exist as two parameters, correction can similarly be performed. The third embodiment adopts a method of performing the correction by flowing a program voltage and a programming current in a pixel circuit (a part) of FIG. 14B similarly to the method described with reference to FIGS. 3A to 3F.

Figure 14C:
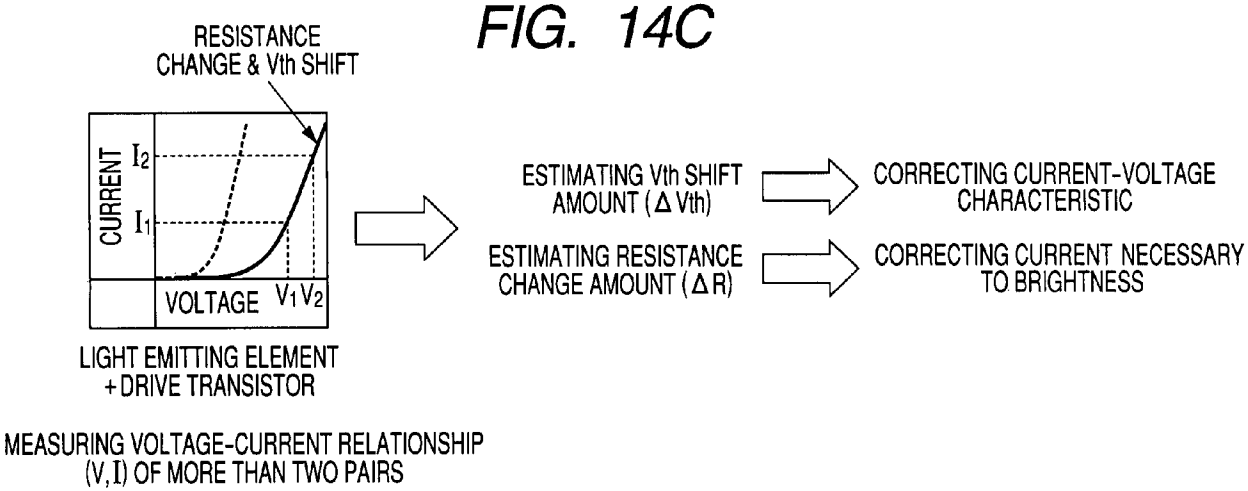

As shown in FIG. 14C, corrected two pairs of the current and voltage values are obtained. Thereby the threshold voltage $V_1$ of an actual drive transistor is obtained, and the resistance change amount (AR) of the light emitting element can also be estimated.

The threshold voltage $V_1$ of the actual drive transistor can be obtained by solving the first formula mentioned above by substituting the two pairs of the current and voltage values for the aforesaid first formula. The resistance change amount (ΔR) of the light emitting element can be obtained from a obtained by solving the first formula by substituting the two pairs of the current and voltage values for the first formula.

The reason is that the voltage between the drain and the source of the transistor changes due to the resistance change of the light emitting element and this changes the current flowing through the transistor. By these operations the data table can be corrected correspondingly to the changes of the two parameters.

Figure 15A:
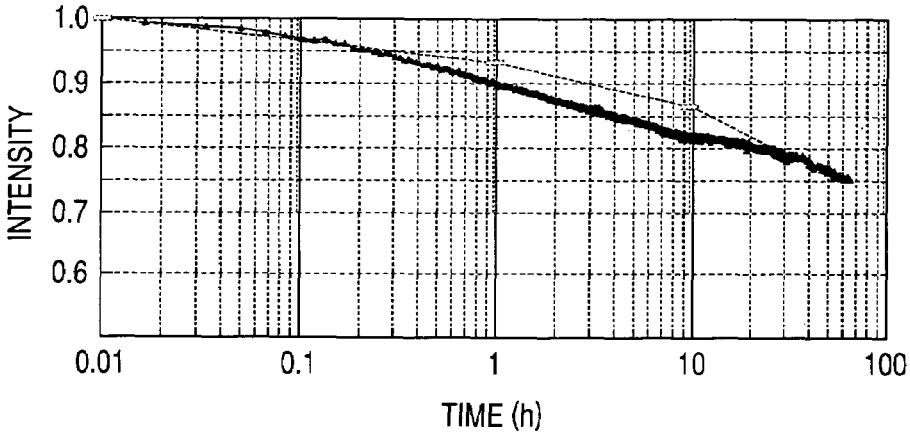
FIGS. 15A and 15B are graphs showing the time changes of brightness and resistance values of an organic EL element of the present invention.
Figure 15B:
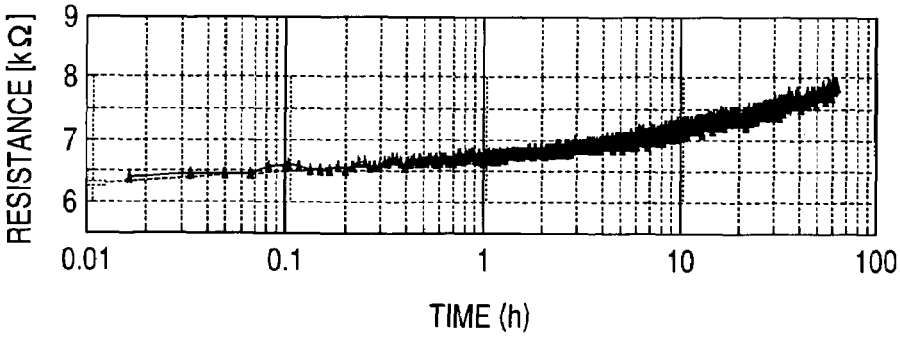

On the other hand, it is known that, as shown in FIGS. 15A and 15B, the brightness of an organic EL element (a kind of the light emitting element) falls as time passes even if the organic EL element is driven by a constant current drive and the resistance value thereof rises at the same time. The conventionally known correction method cannot correct the changes of the current brightness characteristic of the light emitting element.

In the present invention, as described with reference to FIGS. 14A to 14C, the main electrode of the transistor and the light emitting element are connected to each other in series, and consequently the resistance changes of the light emitting element can be presumed. The changes of the current brightness characteristic of the light emitting element can be corrected by using the function. In the following, the procedure will be described.

▲ points shown in FIG. 15A indicate the characteristic of brightness falling as time passes when it is assumed that the initial brightness of the light emitting element (organic EL) has a light emitting area of 3 $mm^2$ in the constant current drive state thereof is 1. ▲ points shown in FIG. 15B indicate the characteristic of the same light emitting element in which the element resistance changes (rises) as time passes. The resistance (R) and brightness (Int) characteristic can roughly be expressed by the following empirical formula.

$$Int=-0.167\times R+2.05$$

The brightness Int is a relative value to the initial brightness of 1, and the resistance R is assumed to be expressed by kΩ. The ▲ points shown in FIGS. 15A and 15B are the points plotted by the empirical formula.

The expression of the empirical formula means that the change amount of the brightness Int can be known to be corrected by knowing the resistance value change of the light emitting element. As described with reference to FIGS. 14A to 14C, the correction of the data table can be performed by observing the two parameters (the threshold voltage change of a drive transistor and the resistance value change of the light emitting element). In addition, according to the present invention, the brightness change amount can be calculated from the resistance change amount of the light emitting element. By reflecting the brightness change amount on the data table, the current brightness characteristic of the light emitting element can be corrected even if the current brightness characteristic changes.

To put it concretely, the correction method is described as follows.

First, the operation of applying the same voltage to the gate electrode and the source electrode of a drive transistor in a system in which the drive transistor and a light emitting element are connected to each other in series is premised. Moreover, the drive transistor is assumed to operate in a linear region, and a drain current Id is assumed to be expressed as:

$$Id=a(V-V_0),$$

for simplification. The drain current Id is the same as the current value flowing through the light emitting element, and is almost in a proportionality relationship with the brightness. Normally, the current value Id is specified by using a data table, an equation, and the like, with respect to the necessary brightness.

First, the parameters given to the data table as initial characteristics are assumed to be the followings:

$V_1$=3.95 [V], $\alpha$=0.204$E$−6, $R$=0.4$E$6[Ω], $Int$=−3.0$E$−6×$R$[Ω]+2.2 (in case of 10 [μA]), $a$=1.68$E$−6, and $V_0$=1 [V], where $V_0$ denotes the threshold of the drive transistor and $V_1$ denotes the threshold of the whole system in which the drive transistor and the light emitting element are connected in series.

On the other hand, it is assumed that the value of (I, V)=(5 [μA], 9.7 [V]), (10 [μA], 11.8 [V]) have been obtained as a result of the measurement of the potential of the data line at the applied current value of two points. If the numerical value is substituted for the aforesaid relational expression:

$$I=\alpha(V-V_1)^2,$$

and the relational expression is operated, then the following results can be obtained:

$\alpha$=0.195 E−6 and $V_1$=4.63.

As a result, it is shown that the value $V_1$ shifts to the positive side by 0.68 V. If it is assumed that the threshold shift is caused by the drive transistor, it is known that the threshold of the drive transistor shifts to the positive side by 0.68 [V]. From this result, the threshold $V_0$ has changed to 1.68 [V]. If the voltage between the source and the drain of the drive transistor is calculated on the premise of $V_0$=1.68, a=1.68 E−6, and (I, V)=(10 [μA], 11.8), then the voltage is 7.63 V, and the voltage allotted to the light emitting element is 4.17 V (=11.8−7.63). From this result, the resistance value R of the light emitting element is:

$$R=0.417E6\ [\Omega],$$

and it is known that the resistance value R has increased from the initial value (0.4E6 [Ω]). Furthermore, it can be calculated from the resistance change of the light emitting element that the brightness (Int) has decreased from 1 to 0.95 by 5%.

From this result, the correction of the threshold shift amount and the correction of the brightness deterioration can be performed. In the example mentioned above, the value of the threshold $V_0$ in the initial characteristic is replaced with a measurement value; the value of $\alpha$ in the initial characteristic is replaced with a measurement value (0.195E−6); the current value to be flown to the necessary brightness is increased by 5% (the data table, the equation, and the like, are changed); and thereby the correction can be completed.

In the above, although the exemplary embodiments of the present invention have been described by citing examples, the active-matrix display of the present invention can be configured as follows commonly in each embodiment.

That is, in the active-matrix display, the control unit that determines a potential change can be arranged for every data line. The reason is that potential changes for one line in a select line direction can be determined in a lump by arranging the control unit every data line. However, the control unit is not necessarily arranged for every data line, and the number of the control units can be a smaller number than the number of the data lines to be driven by performing time-sharing. For example, a multiplexer may be provided every plurality of data line, and a control unit may be provided every multiplexer.

Figure 5:
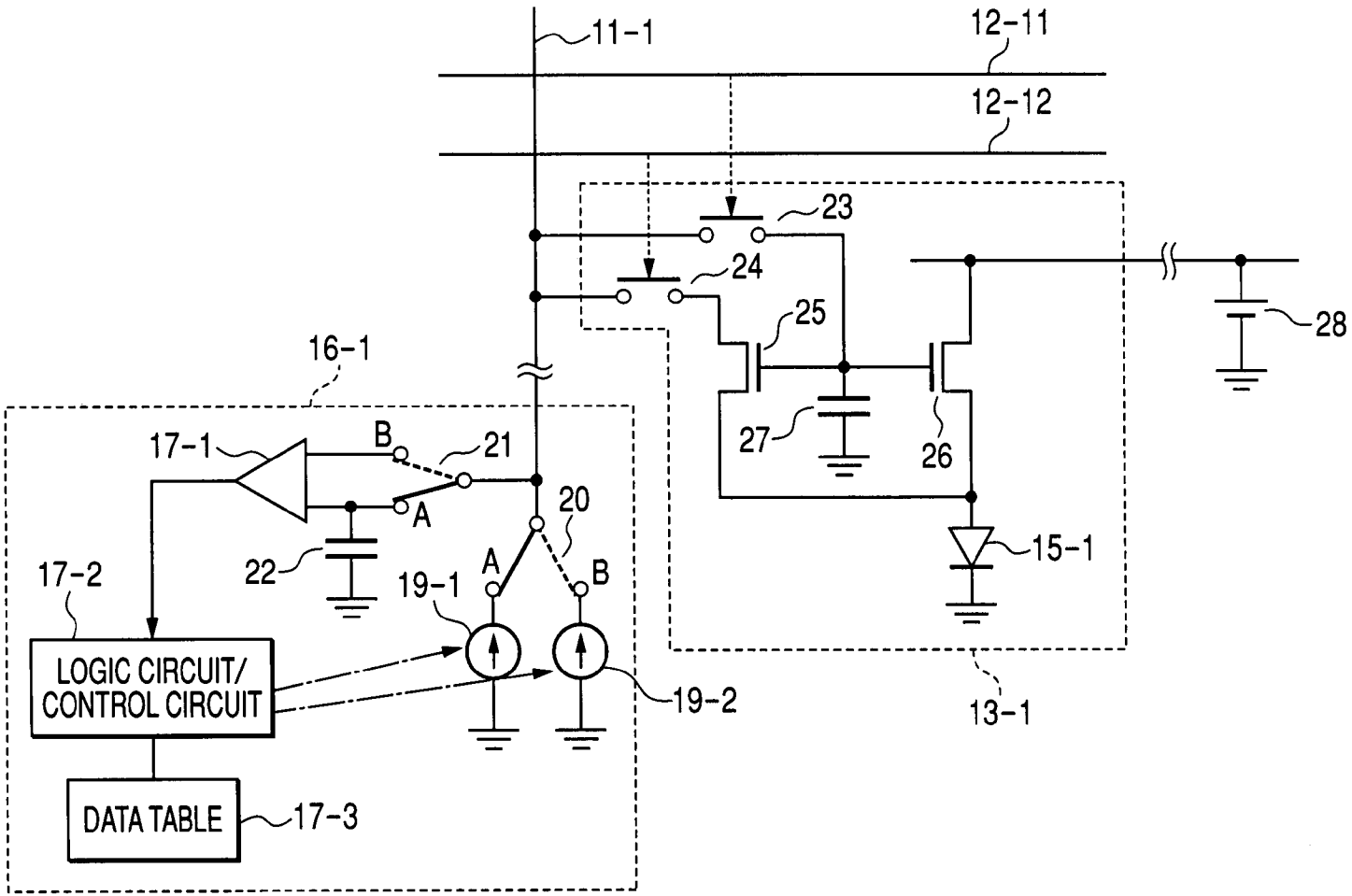
FIG. 5 is a diagram showing the configurations of a pixel and a control unit according to a further exemplary embodiment of the present invention.

Moreover, a pre-charge current source (first current source) may be used in place of the voltage source at the time of performing the pre-charge of the present invention. FIG. 5 shows the case where the pre-charge current source 19-1 is used in place of the voltage source 18 at the time of performing the pre-charge. The current source 19-2 (which is the second current source) shown in FIG. 5 is the same current source as the current source 19 in FIG. 2. Two select lines 12-11 and 12-12 are provided to the pixel 14-1 in order to separately control the switches 23 and 24. When the switch 20 is switched over to the A side, the switch 23 is turned on and the switch 24 is turned off in the pixel 14-1 by the control of the select lines 12-11 and 12-12, and a current value necessary to program the predetermined voltage into the holding capacitor 27 is flown for a predetermined time. At this time, the predetermined voltage is also held in the capacitor 22 of the control unit 16-1. Next, when the switch 20 is switched over to the B side, both of the switches 23 and 24 in the pixel 14-1 are turned on, and the turning-on of the switches 23 and 24 switches the application of the current to the application of the current of the value reflected by the necessary brightness in accordance with the data table 17-3. At this time, the potential changes of the data line 11-1 are observed. The observation of the potential changes of the data line 11-1 is performed by comparing the pre-charge voltage held in the capacitor 22 with the potential of the data line 11-1 with the comparator 17-1, and by changing the electric characteristic data of the electric characteristic data table 17-3 on the basis of the information of the magnitude relationship. By the operation, the function similar to the use of the pre-charge voltage source can be obtained.

Moreover, it is also possible to adjust an application time by applying a larger value than the voltage value or the current value to be programmed in the pixel circuit 14-1 as the pre-charge voltage or the pre-charge current in the pre-charge voltage or the pre-charge current of the active-matrix display. By such an operation, the time necessary for the pre-charge can be further reduced. However, the application time can be reasonably adjusted so as to prevent the application of an excessive voltage to the pixel circuit 14-1 and the light emitting element 15-1.

Moreover, the active-matrix display may further include a plurality of holding capacitors. For example, there is a case of further providing a threshold correcting holding capacitor in a specific transistor in a pixel. Moreover, it is also possible to dividedly arrange the holding capacitor as a plurality of capacitors, and to change the occupation form of the pixel circuit.

A once programmed application voltage can substantially be kept until the next access, by providing a holding capacitor to each pixel circuit.

Moreover, it is required for the active-matrix display to include a path through which the current supplied from the data line flows to the light emitting element in the pixel circuit. In the present invention, because the operation of measuring the potential of the data line is performed while flowing the current through the light emitting element, the pixel circuit is required to include a path along which the current supplied from the data line flows through the light emitting element.

Moreover, the active-matrix display may include a current mirror circuit including switching elements in the pixel circuit. The current mirror circuit corresponds to the pixel circuit including the current verifying unit. The current mirror circuit has the ability of verifying the current value to be flown through the light emitting element constituting the pixel.

Moreover, in the active-matrix display, the plurality of switching elements may be thin film transistors. In particular, if a glass, plastic, and metal substrates are used, it is effective that the thin film transistors are formed on a substrate to function as switches.

Moreover, the active layers of the plurality of thin film transistors may be made of a material including silicon as the main component. As the examples of the materials including silicon as the main component, amorphous silicon, polycrystalline silicon, single crystal silicon, and the like, can be used. The materials in which impurities such as phosphorus, boron, and arsenic are doped may be also used.

Moreover, the active layers of the plurality of thin film transistors may be made of the materials including metal oxide as a main component.

As the examples of the materials including metal oxide as the main component, tin oxide, zirconium oxide, indium oxide, a composite oxide including the plurality of oxides, and the like, can be used. Impurities may be doped in these materials.

Moreover, the active layers of the plurality of thin film transistors may be made of the materials including an organic substance as the main component.

As the examples of the materials including an organic substance as the main component, pentacene, tetracene, anthracene, metal phthalocyanine, porphyrin group organic matter, and the like, can be used. Impurities may be doped in these materials.

If amorphous silicon TFTs or amorphous oxide semiconductor TFTs, which have smaller mobility and inferior driving force in comparison with those of low temperature polysilicon TFT, are used (such TFTs are required for the applications for a large screen display and the like), it is difficult to use the TFTs in their saturation regions. The reasons are that the materials mentioned above cannot originally obtain sufficient saturation characteristics, and that power consumption becomes too large when their drive voltages are raised (when they are operated in their saturation regions). Consequently, if the amorphous silicon TFTs, the amorphous oxide semiconductor TFTs, and the like, which have inferior drive forces, are used, it is necessary to use a drive method capable of correcting the characteristic variations of the TFTs and the OLEDs in the regions in which the TFTs are not sufficiently saturated.

The present invention is also effective in the case where transistors having lower mobility and inferior drive forces, such as the thin film transistors including active layers including amorphous silicon, amorphous metal oxide, organic substances, and the like as the main component, in comparison with those of the single crystal or polycrystalline silicon TFTs are used.

The reason is that, even if the saturation characteristics of transistors are not sufficient and the characteristic drifts of light emitting elements also occur, a superior compensation function can be obtained by the present invention.

According to the present invention, additional wiring for feedback is not necessary for the matrix circuit section, and consequently the increase of parasitic capacitance is remarkably little. Consequently, high speed driving can be performed without sacrificing the compensation performance. Then, the problem of the high speed drive, which is owned by the comparative example, can be resolved.

Fourth Embodiment

Figure 6:
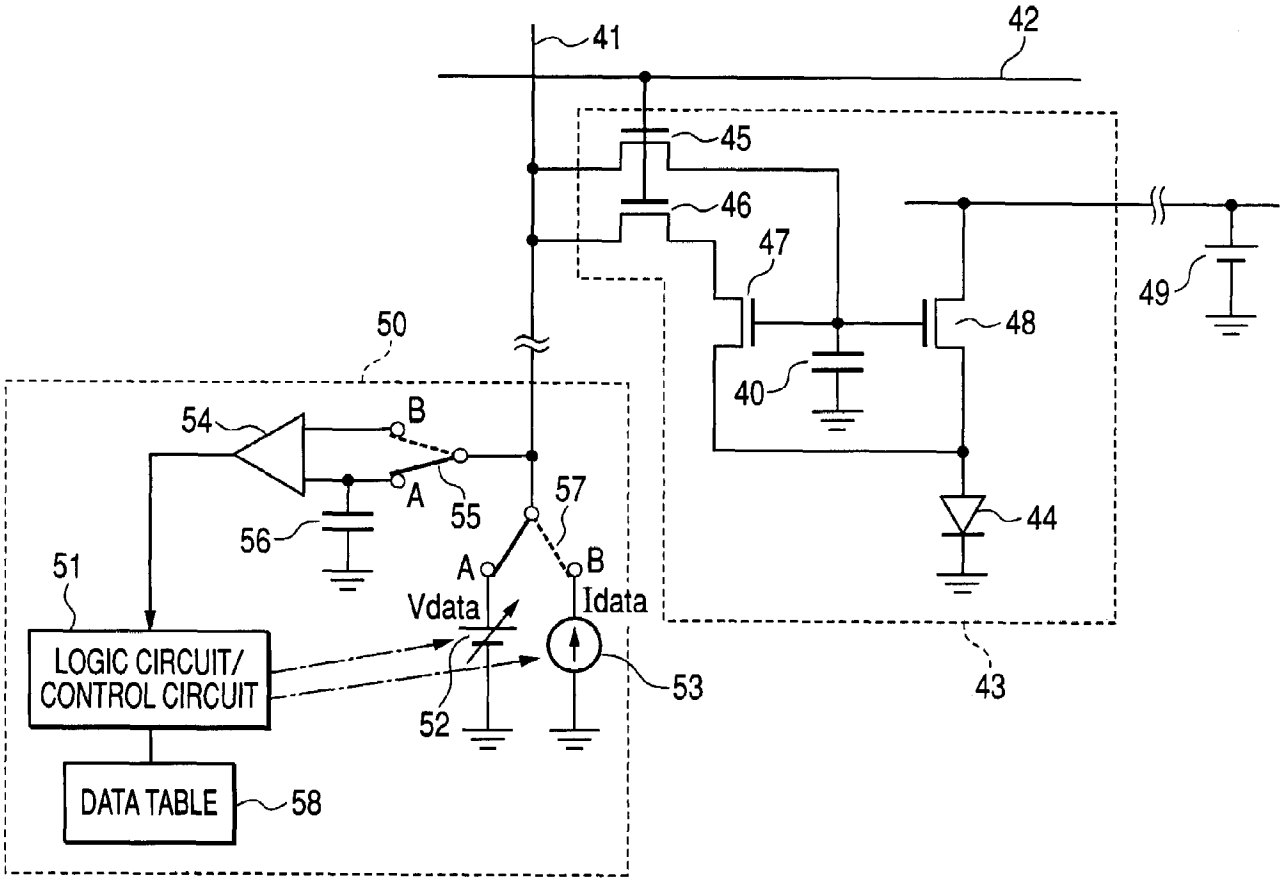
FIG. 6 is a schematic diagram showing the configurations of a pixel and a control unit of an active-matrix display of a first embodiment of the present invention.
Figure 7:
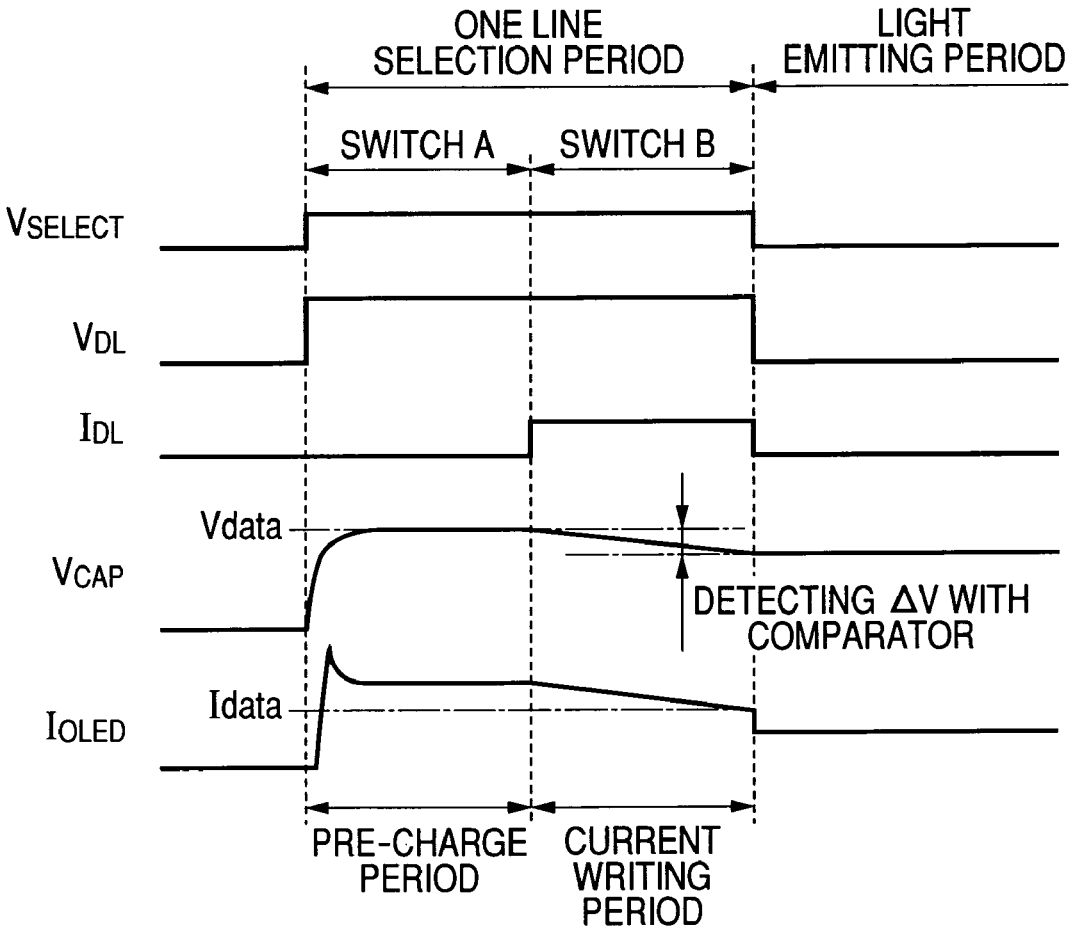
FIG. 7 is a diagram showing voltage applying timing of the active-matrix display according to the first embodiment of the present invention.

FIG. 6 is a schematic diagram showing the configurations of a pixel and a control unit of an active-matrix display of a fourth embodiment of the present invention. Moreover, FIG. 7 is a voltage applying timing diagram for showing the drive state based on the configurations of FIG. 6. FIG. 6 shows the configurations of a pixel 43 and a control unit 50 connected to a data line 41. The different point of the configurations of FIG. 6 from those of FIG. 2 is the use of transistors 45 and 46 as switches.

As shown in FIG. 6, the pixel 43 is arranged correspondingly to the intersection point of the intersecting data line 41 and a select line 42.

The control unit 50 is connected to the data line 41. The control unit 50 includes a voltage source 52 generating a pre-charge voltage, a current source 53 for flowing a predetermined current, an AD converter 54, which functions as a comparator, a logic circuit/control circuit 51, a data table 58 connected to the logic circuit/control circuit 51, and switches 55 and 57. The AD converter 54 and the logic circuit/control circuit 51 constitute a detection circuit. The switch 57 performs the switching of connecting either of the voltage source 52 and the current source 53 to the data line 41. The switch 55 performs the switching of connecting either of the two input of the comparator 54 to the data line 41. A capacitor 56 is connected to one of input terminals of the AD converter 54.

The pixel 43 includes a pixel circuit and an organic EL element 44, and the pixel circuit includes transistors 45 and 46, which are a first and second switches, respectively, and transistors 47 and 48 constituting a current mirror circuit. The pixel 43 further includes a holding capacitor 40 holding a voltage, and a voltage source 49 connected to the source of the transistor 48.

In FIG. 7, $V_{SELECT}$ denotes voltage application to the select line 42; $V_{DL}$ denotes a setting voltage of the voltage source 52; $I_{DL}$ denotes a setting current of the current source 53; $V_{CAP}$ denotes a potential change of capacity; and $I_{OLED}$ denotes a current flowing into the organic EL element 44 through the data line 41. The abscissa axis indicates time.

SWITCH A denotes a period during which the switches 55 and 57 are switched to the A side (the voltage source 52 and the data line 41 are connected to each other), and SWITCH B denotes a period during which the switches 55 and 57 are switched to the B side (the current source 53 and the data line 41 are connected with each other). PRE-CHARGE PERIOD denotes a first selection period (the period is a first step), CURRENT WRITING PERIOD denotes a second selection period (the period is a second step). LIGHT EMITTING PERIOD follows CURRENT WRITING PERIOD. In LIGHT EMITTING PERIOD, the transistors 45 and 46 are turned off, and a current ($I_{OLED}$) based on the holding capacitor, that is, the voltage ($V_{CAP}$) set at the gate of the transistor 48 flows through the organic EL element 44.

When the signal $V_{SELECT}$ of a row select line changes to the H level, the switches 45 and 46 of the pixel circuit 43 are closed. The control unit 50 first sets the voltage of the voltage source 52 to the voltage $V_{data}$, and switches the switches 55 and 57 to their A sides. As the holding capacity 40 are being charged through the switch 45, the holding capacity potential $V_{cap}$, that is, the data line potential, rises, and finally reaches the setting voltage $V_{data}$ of the voltage source 52.

The current $I_{OLED}$ flowing into the pixel 43 through the data line 41 flows to the organic light emitting element 44 through the switch 46 and the transistor 47. The data line current $I_{OLED}$ first flows in a large quantity in order to charge parasitic capacitance, and reaches to the steady state thereof after that. The steady state current value is determined on the basis of the gate-source voltage of the transistor 47 when the voltage $V_{CAP}$ of the holding capacity becomes the voltage $V_{data}$.

Next, the control unit 50 sets the current of the current source 53 to a value $I_{data}$, and switches over the switches 55 and 57 to their B sides.

In this case, because the holding capacity voltage corresponding to the current $I_{OLED}$ necessary to obtain desired brightness is smaller than the voltage $V_{data}$, the data line potential $V_{cap}$ falls in the current writing period. Because the data line current in PRE-CHARGE PERIOD has been too large, the current flowing through the data line 41 is decreasing to the value $I_{data}$ of the set current signal.

A variation ΔV of the data line potential $V_{cap}$ is detected at suitable timing by the AD converter 54, and the result is transmitted to the logic circuit/control circuit 51. Then the data table 58 is rewritten.

Figure 8:
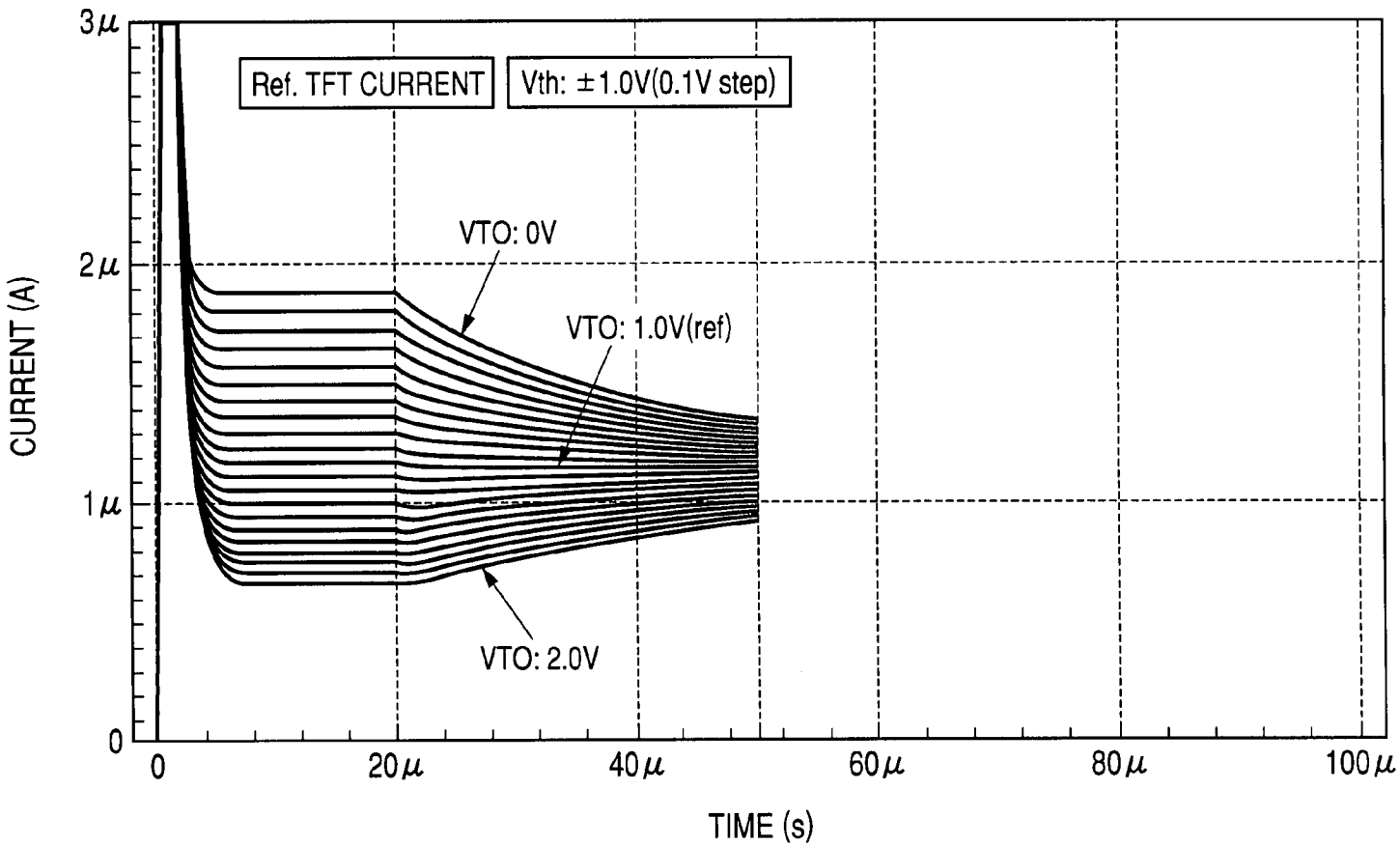
FIG. 8 is diagram showing the calculation results of the active-matrix display according to the first embodiment of the present invention.

A result of the performance of simulation program with integrated circuit emphasis (SPIC) simulation on the basis of the circuit diagram is shown in FIG. 8. For the simulation of the characteristic of a TFT, SPICE MODEL Level 15 was used, and the simulation of the characteristic of the organic EL element (OLED) was performed by combining the diode model and capacitor to fit the characteristic.

On the SPICE simulator, it was previously defined that the threshold voltage $V_{th}$ of the organic EL element was 3 V, and a corresponding pre-charge voltage was applied to the data line 41. Furthermore, a predetermined current value 1 μA is applied to calculate the potential change of the data line 41.

As a result, the changes of the current flowing through the transistor 47 in FIG. 6 are shown in FIG. 8. The characteristic curves denoted by "Ref." in FIG. 8 are the changes of the current. Because the pre-charge voltage was reasonable, it was known that the TFT current at the time of the current application hardly changed.

Furthermore, the threshold voltage of the TFT was assumed to vary by ±1 V in the similar drive conditions, and similar calculation was performed. As the result, it was found that the value of the current flowing through the transistor 47 at the time of the current application intergraded toward a predetermined value (1 μA in this case). By observing the intergradation amount as the voltage change amount of the data line 41, the correction operation of the data table 58 can be performed.

By performing the similar operation using two different program voltage values, the threshold voltage shift amount of the drive transistor and the resistance change amount of the light emitting element (organic EL) can be calculated. Furthermore, the change amount of the current brightness characteristic of the light emitting element can be estimated on the basis of the resistance change amount of the light emitting element (organic EL), and the correction operation of the data table can further be performed.

Fifth Embodiment

Figure 9:
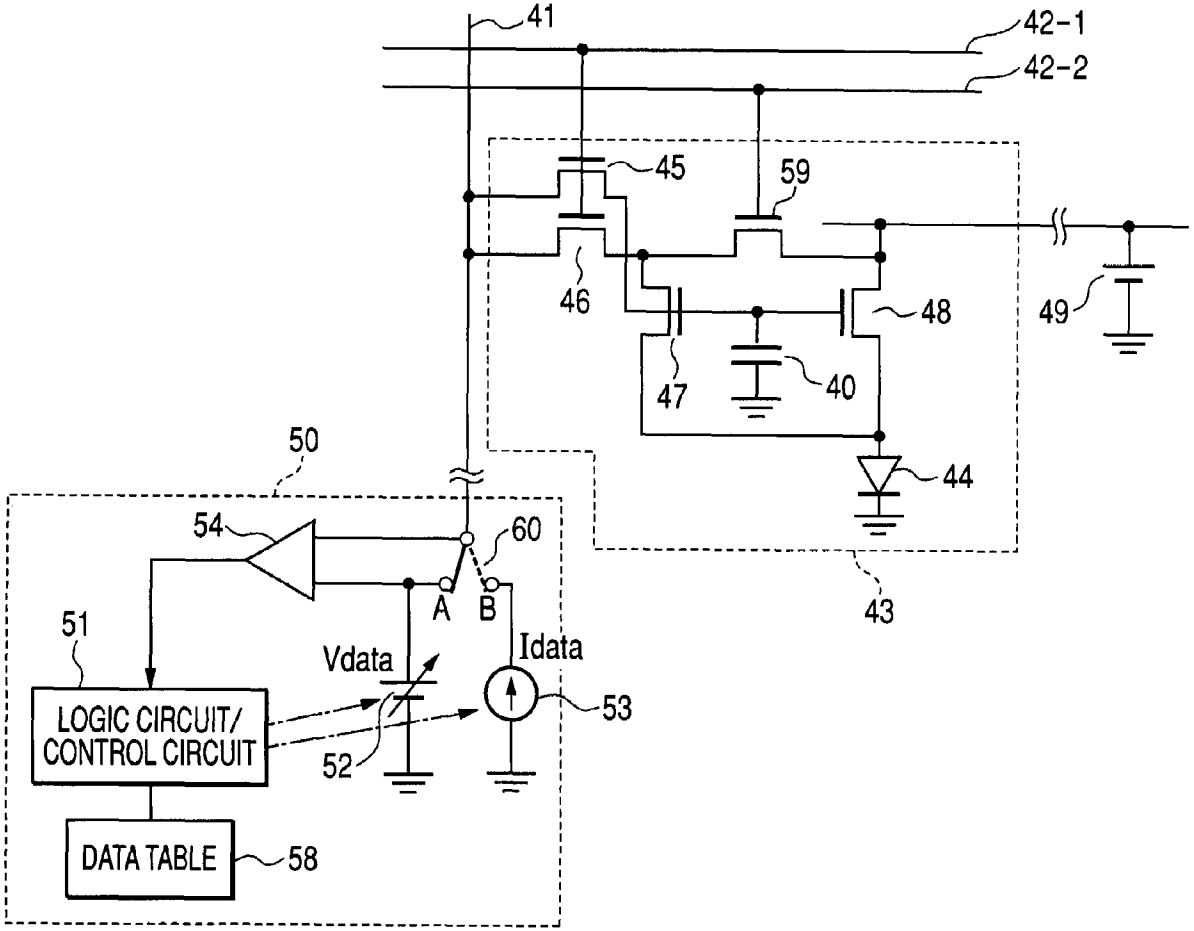
FIG. 9 is a schematic diagram showing the configurations of a pixel and a control unit of the active-matrix display of a second embodiment of the present invention.

FIG. 9 is a schematic diagram showing the configurations of a pixel and a control unit of the active-matrix display of a fifth embodiment of the present invention. The configuration shown in FIG. 9 includes a transistor 59 added to compensate the defect of the current minor circuit, and is adapted to flow a current through both of the transistors 47 and 48 to equalize the loads of the transistors 47 and 48 when the organic EL element 44 is kept to emit a light. The on-off control of the transistors 45 and 46 is performed through the select line 42-1, and the on-off control of the transistor 59 is performed through the select line 42-2. The control unit 50 is provided with a switch 60, and the two input terminals of the A/D converter 54 are put at the common potential when the data line 41 and the voltage source 52 are connected with each other (when the switch 60 is switched over to the A terminal side thereof). On the other hand, when the data line 41 and the current source 53 are connected to each other by the switch 60 (when the switch 60 is switched over to the B terminal side), the voltage of the voltage source 52 is applied to one of input terminals of the A/D converter 54 and the potential of the data line 41 is applied to the other input terminal. In the present embodiment, the number of switches is made to be one, and the capacitor 56 can be removed in comparison with the control unit 50 illustrated in FIG. 6 to reduce the number of parts.

Figure 10:
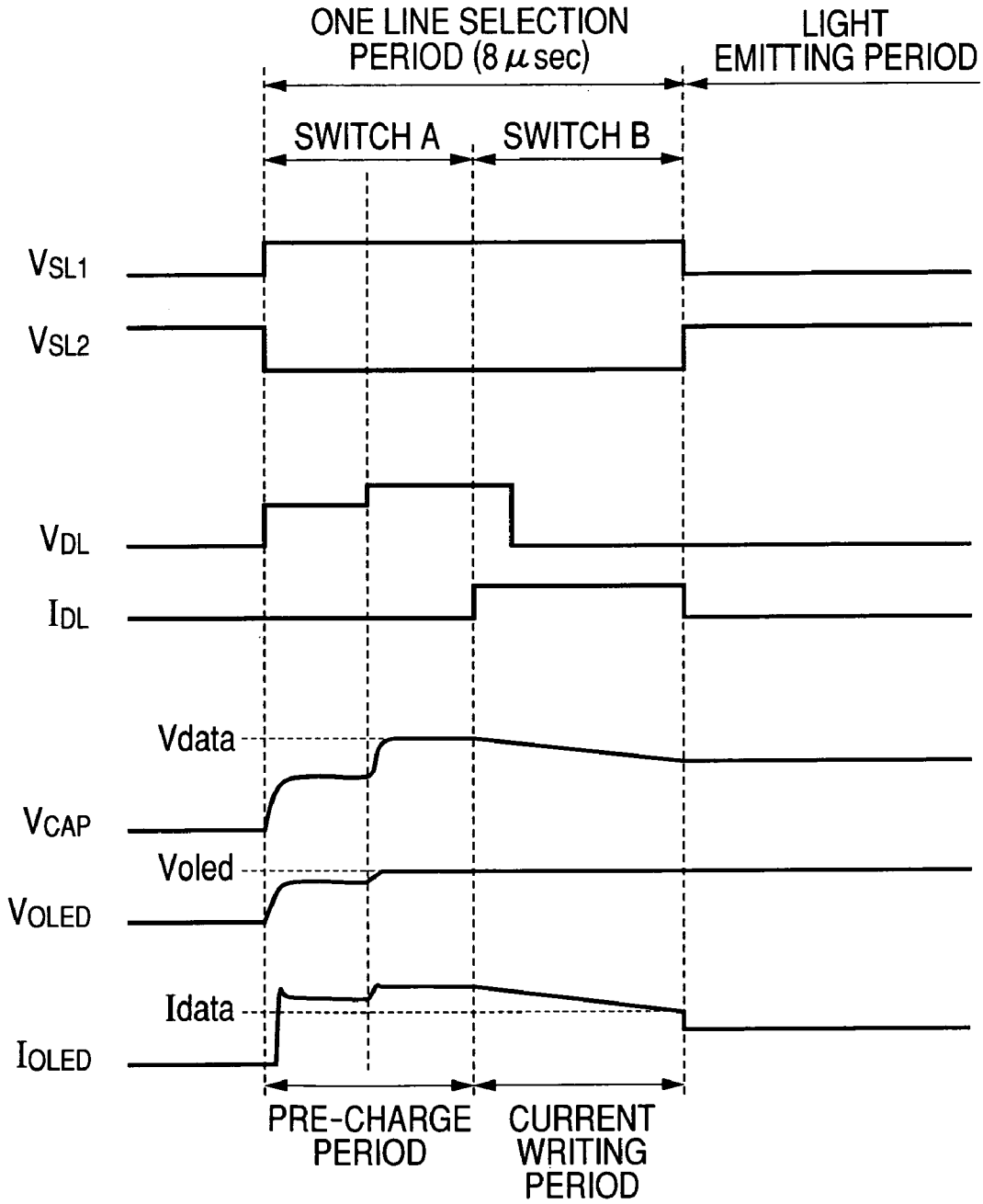
FIG. 10 is a diagram showing voltage applying timing of the active-matrix display of the second embodiment of the present invention.

FIG. 10 is a voltage applying timing diagram in the pixel circuit shown in FIG. 9. In FIG. 10, $V_{SEL1}$, $V_{SEL2}$ denote the voltage application to the select lines 42-1 and 42-2, respectively; $V_{DL}$ denotes the voltage application from the voltage source 52 to the data line 41; $I_{DL}$ denotes the current application from the current source 53 to the data line 41, $V_{CAP}$ denotes the potential change of the capacity; $V_{OLED}$ and $I_{OLED}$ denote a voltage change applied to the organic EL element and a change of the current flowing through the organic EL element, respectively. SWITCH A denotes the period in which the switch 60 is switched over to the A side thereof (the voltage source 52 and the data line 41 are connected to each other), and SWITCH B denotes the period in which the switch 60 is switched over to the B side thereof (the current source 53 and the data line 41 are connected with each other).

In this example, the voltage of the voltage application $V_{DL}$ rises in two-stage manner, and the rising way is the method of preventing the rise of the voltage of the data line 41 from being excessively large. By such an operation, the load of the organic EL element 44 can be reduced.

The effects of the present invention could similarly be confirmed also in these pixel circuit and control unit.

Sixth Embodiment

Figure 11:
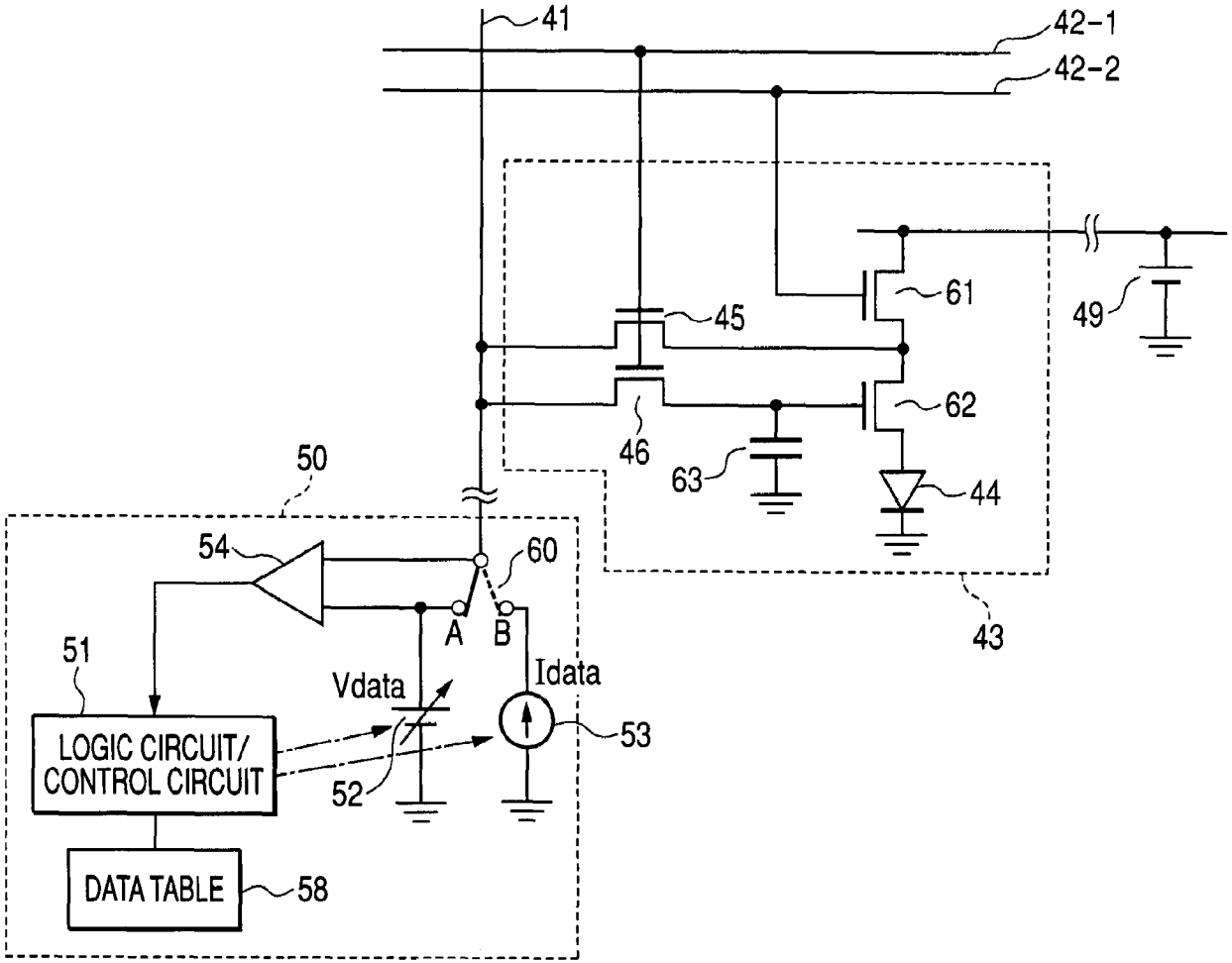
FIG. 11 is a schematic diagram showing the configurations of a pixel and a control unit of the active-matrix display of a third embodiment of the present invention.

FIG. 11 is a schematic diagram showing the configurations of a pixel and a control circuit of the active-matrix display of a sixth embodiment of the present invention. FIG. 11 shows the configuration of replacing the current mirror circuit of the second embodiment with a transistor 62. A switch 61 switching in the line selection period and in the light emitting period is provided. In the programming period, the transistor 62 is connected to the data line 41, and in the light emitting period, the transistor 62 is connected to the power source 49. The circuit configuration of the control unit 50 is the same configuration as that of the control unit in FIG. 9. Also in this circuit diagram, a path along which the current supplied from the data line 41 flows to the light emitting element 44 (organic EL) is provided. In the present embodiment, as shown in FIG. 11, a transistor 61 and the transistor 62 are connected with each other in series, and are connected to the organic EL element 44. A transistor 45 is connected to the connection point of the transistor 61 and the transistor 62, and a transistor 46 is connected to the gate of the transistor 62. The on-off control of the transistor 61 is performed through the select line 42-2. A holding capacitor 63 is connected to the gate of the transistor 62.

The switch 60 is provided in the control unit 50. When the data line 41 is connected to the voltage source 52 (when the switch 60 is switched over to the A terminal side thereof), the two input terminals of the comparator 64 are put in a state of being at common potential. On the other hand, when the switch 60 connects the data line 41 with the current source 53 (when the switch 60 is switched to the B terminal side thereof), the voltage of the voltage source 52 is applied to one of the input terminals of the comparator 64, and the potential of the data line 41 is applied to the other input terminal of the comparator 64. In the case of the configuration of the control unit 50, the voltage of the voltage source 52 is applied to the input terminal of the comparator 64 on one side, and the potential of the data line 41 is applied to the other input terminal of the comparator 64. Then only the magnitudes of both are detected. Consequently, an application voltage only for a previously set application voltage changing value is changed (the data table 58 is changed), and it is needed to perform the similar measurement routine. A pair of correction value is obtained by repeating the measurement routine until the magnitude relationship between the voltage of the voltage source 52 and the potential of the data line 41 on the other input terminal is inverted. Furthermore, it is needed to obtain two or more pairs of correction values by using other application voltage values.

Figure 12:
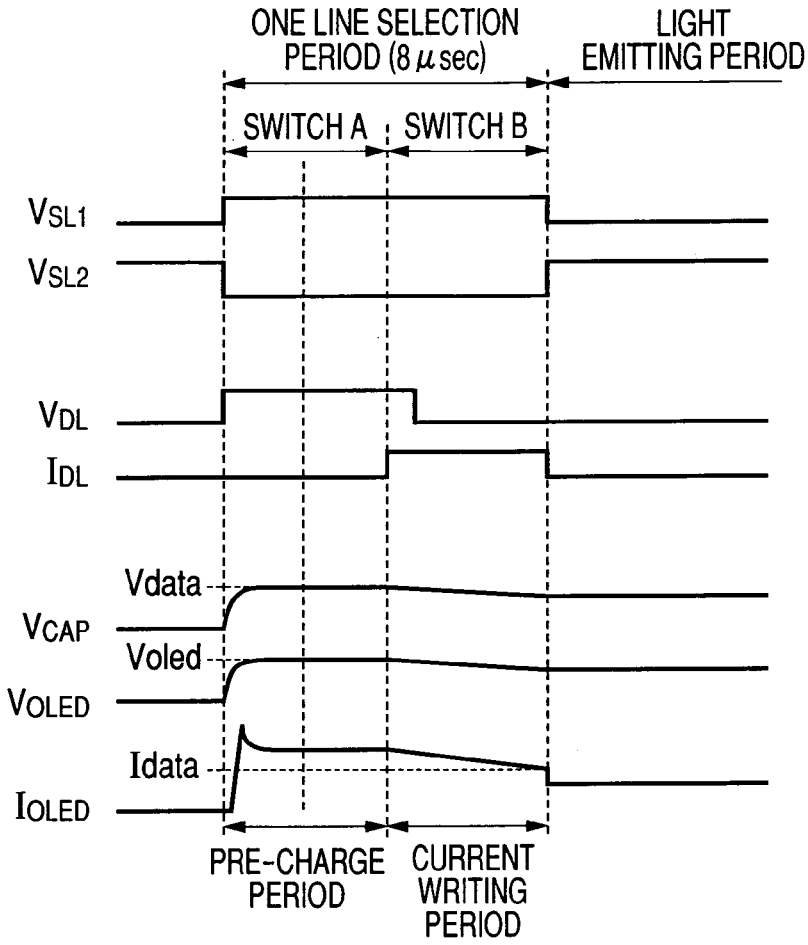
FIG. 12 is a diagram showing voltage applying timing of the active-matrix display of the third embodiment of the present invention.
Figure 13:
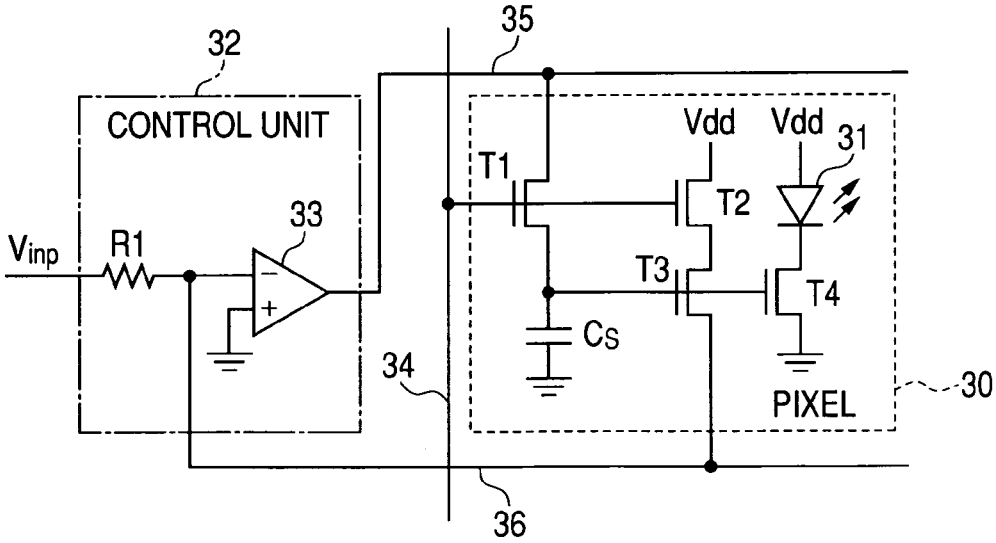
FIG. 13 is a diagram showing a feedback drive circuit in the specification of Canadian Patent No. 2,472,689.

FIG. 12 is a voltage applying timing diagram in the pixel circuit shown in FIG. 11.

In these pixel circuits, the effects of the present invention was similarly able to be confirmed.

The present invention is applied to an active-matrix display and a drive method thereof, and more particularly can be utilized in a display device emitting light by flowing a current as a light emitting element, such as an organic EL element and an inorganic EL element.

While the present invention has been described with reference to the exemplary embodiments, it is to be understood that the invention is not limited to the disclosed exemplary embodiments. The scope of the following claims is to be accorded the broadcast interpretation so as to encompass all such modifications and equivalent structures and functions.

This application claims the benefit of Japanese Patent Applications Nos. 2007-143501, filed May 30, 2007, 2007-259806, filed Oct. 3, 2007, and 2008-119728, filed May 1, 2008, which are hereby incorporated by reference herein in their entirety.

The invention claimed is:

1. An active-matrix display comprising:

a data line;

one or a plurality of select lines intersecting with the data line;

a control unit that supplies a voltage signal and a current signal to the data line; and a pixel circuit that receives the voltage signal and the current signal from the data line to drive a light emitting element, wherein the pixel circuit includes:

a transistor that controls a current to be supplied to the light emitting element;

a voltage holding unit connected to a gate of the transistor;

a first switch controlled by a signal supplied through the select lines to connect the gate of the transistor to the data line; and a second switch controlled by the signal supplied through the select lines to connect the drain of the transistor to the data line, wherein the control unit includes:

a voltage or first current source that supplies a voltage or current pulse to the data line in order to make the voltage holding unit hold the voltage signal for making the light emitting element emit a light having predetermined brightness in a first selection period in which the first switch is closed by the signal supplied through the select lines;

a second current source that supplies the current signal for making the light emitting element emit the light having the predetermined brightness to the data line in order to make the voltage holding unit hold the current signal in a second selection period in which the first switch and the second switch are closed by the signal supplied through the select lines;

a detection circuit that detects a difference between potential values held in the voltage holding unit respectively in the first selection period and the second selection period; and a correction unit that corrects the voltage signal on the basis of the difference of the potential values, and on the basis of a relationship between the current signal and the detected potential.

2. The active-matrix display according to claim 1, wherein the control unit includes a first storage unit that stores a relationship between the voltage signal and the current signal at a time of making the light emitting element emit the light having the predetermined brightness;

the correction unit corrects the stored relationship between the voltage signal and the current signal on a basis of a relationship between the current signal and the detected potential; and the control unit supplies the voltage signal to the data line on a basis of the corrected relationship.

3. The active-matrix display according to claim 2, wherein the correction unit increases or decreases the voltage signal stored in the storage unit by a predetermined amount on the basis of the difference of the potential values.

4. The active-matrix display according to claim 2, wherein the detection circuit detects the difference of the potential values held respectively in the voltage holding unit in the first selection period and the second selection period;

the correction unit multiplies the voltage signal stored in the storage unit by a predetermined ratio on the basis of the detected difference between the potential values.

5. The active-matrix display according to claim 1, wherein the control unit supplies the potential value detected in the second selection period to the data line as the voltage signal at a time of making the light emitting element emit the light having the predetermined brightness.

6. The active-matrix display according to claim 2, wherein the control unit includes a second storage unit that stores the current signal for each of a plurality of different brightness values and the potential detected by the detection circuit in the second selection period at a time of making the light emitting element emit lights having the plurality of brightness values different from one another; and the correction unit corrects the relationship between the voltage signal and the current signal stored in the first storage unit on the basis of the plurality of current signals and the potential stored in the second storage unit.

7. The active-matrix display according to claim 6, wherein the control unit estimates a change of a current brightness characteristic of the light emitting element on the basis of the relationship between the plurality of current signals and the potential, which are stored in the second storage unit; and the correction unit corrects the voltage signal on the basis of the estimated current brightness characteristic.

8. The active-matrix display according to claim 6, wherein the first storage unit includes an equation defining the relationship between the voltage signal and the current signal; and the correction unit changes a coefficient of the equation on the basis of the plurality of current signals and the potential stored in the second storage unit.

9. The active-matrix display according to claim 1, wherein the detection circuit includes one of a comparator for comparing a difference of pieces of potential stored in the voltage holding unit in the first selection period and the second selection period, and an analog-digital converter.

10. The active-matrix display according to claim 1, wherein the pixel circuit includes a current mirror circuit including the transistor.

11. The active-matrix display according to claim 1, wherein a main electrode of the transistor is connected to the light emitting element in series.

12. A drive method of an active-matrix display including a data line, one or a plurality of select lines intersecting with the data line, a control unit that supplies a voltage signal and a current signal to the data line, and a pixel circuit that receives the voltage signal and the current signal from the data line to drive a light emitting element, wherein the pixel circuit includes a transistor that controls a current to be supplied to the light emitting element, and a voltage holding unit connected to a gate of the transistor, the drive method comprising the steps of:

providing a light emitting period in which the current flows through the light emitting element to make the light emitting element emit a light having predetermined brightness and a selection period in which the current to flow through the light emitting element is set before the light emitting period;

supplying a voltage or current pulse to the data line to make the voltage holding unit hold the voltage signal;

after that, supplying the current signal to the data line to flow the current signal through the transistor;

detecting potential held in the voltage holding unit in the current signal supplying step; and correcting the voltage signal on the basis of a relationship between the current signal and the detected potential and on the basis of the difference of the potential values held in the voltage holding unit during the voltage or current pulse supplying step and during the current signal supplying step.

* * * * *